US012668407B2

(12) United States Patent
Ross

(10) Patent No.: US 12,668,407 B2
(45) Date of Patent: Jun. 30, 2026

(54) CONTAINER AND METALLIC CLOSURE WITH A FLOATING LINER

(71) Applicant: Ball Corporation, Westminster, CO (US)

(72) Inventor: John R. Ross, Broomfield, CO (US)

(73) Assignee: BALL CORPORATION, Westminster, CO (US)

( * ) Notice: Subject to any disclaimer, the term of this patent is extended or adjusted under 35 U.S.C. 154(b) by 0 days.

(21) Appl. No.: 19/015,485

(22) Filed: Jan. 9, 2025

(65) Prior Publication Data

US 2025/0229962 A1 Jul. 17, 2025

Related U.S. Application Data

(60) Provisional application No. 63/620,545, filed on Jan. 12, 2024.

(51) Int. Cl.
*B65D 53/04* (2006.01)
*B65D 41/04* (2006.01)

(52) U.S. Cl.
CPC ..... *B65D 53/04* (2013.01); *B65D 41/045* (2013.01); *B65D 2251/0015* (2013.01); *B65D 2251/0093* (2013.01)

(58) Field of Classification Search
CPC .. B65D 41/045; B65D 41/0435; B65D 41/04; B65D 41/0457; B65D 53/04; B65D 2543/00981; B65D 2543/00962; B65D 2543/00953
USPC ... 215/341, 343, 349, 363, 364, 355, 45, 43; 220/804, 806, 801, 657, 656, 227, 222, 220/221, 216
See application file for complete search history.

(56) References Cited

U.S. PATENT DOCUMENTS 3,603,472 A * 9/1971 Lecinski, Jr. ..... B65D 41/08 215/346
4,415,096 A * 11/1983 Ohmi ..... B65D 53/04 215/343
2004/0069739 A1* 4/2004 Zumbuhl ..... B65D 41/045 215/349
2007/0034593 A1* 2/2007 Ichimura ..... B65D 41/348 215/349

FOREIGN PATENT DOCUMENTS

WO WO-2006062357 A1 * 6/2006 ..... B65D 51/228

* cited by examiner

*Primary Examiner* — Robert J Hicks
(74) *Attorney, Agent, or Firm* — Sheridan Ross P.C.

(57) ABSTRACT

The present disclosure generally relates to the manufacture and sealing of containers formed of metallic material or glass with metallic closures, and more specifically to an apparatus and methods used to seal containers with a Roll-on Pilfer Proof (ROPP) closure or a prethreaded closure. The closure includes a floating liner that is not attached to the closure such that the liner can move relative to a lower surface of the closure. The floating liner may comprise a polymer, a metal, a high-durometer material, and/or an elastic material. The floating liner includes an inner plug seal that seals or seats on an inner surface of a curl of the container. The floating liner can optionally include an outer alignment support configured to align with and/or be positioned adjacent to an outer surface of the curl.

20 Claims, 12 Drawing Sheets

| | | RAW DATA | | | | FEATURE DISTANCE FROM CURL CENTERLINE | | | | | |
|---|---|---|---|---|---|---|---|---|---|---|---|
| SAMPLE | PROFILE ANGLE | LEFT THREAD PEAK (DATUM) | LEFT CURL OD | RIGHT CURL OD | RIGHT THREAD PEAK | LEFT THREAD | LEFT CURL | RIGHT CURL | RIGHT THREAD | CURL VS THREAD CENTERLINE DIFF (in) (X,Y) | NON-CONCENTRICITY (in) (h) DISTANCE |
| 1 | 0, 180 | 0 | 0.0608 | 1.382 | 1.4603 | 0.7214 | 0.6606 | 0.6606 | 0.7389 | 0.0088 | 0.0088 |
| 1 | 90, 270 | 0 | 0.07 | 1.39 | 1.461 | 0.7300 | 0.6600 | 0.6600 | 0.7310 | 0.0005 | |
| 2 | 0, 180 | 0 | 0.0732 | 1.3879 | 1.4526 | 0.7306 | 0.6574 | 0.6574 | 0.7221 | -0.0042 | 0.0050 |
| 2 | 90, 270 | 0 | 0.0666 | 1.3867 | 1.4587 | 0.7267 | 0.6601 | 0.6601 | 0.7321 | 0.0027 | |
| 3 | 0, 180 | 0 | 0.0619 | 1.38 | 1.4544 | 0.7210 | 0.6591 | 0.6591 | 0.7335 | 0.0062 | 0.0071 |
| 3 | 90, 270 | 0 | 0.0705 | 1.3893 | 1.4531 | 0.7299 | 0.6594 | 0.6594 | 0.7232 | -0.0033 | |
| | | | | | | | | | | AVERAGE | 0.0070 |

TABLE 1

CONTAINER AND METALLIC CLOSURE WITH A FLOATING LINER

CROSS REFERENCE TO RELATED APPLICATIONS

This application claims priority and benefits under 35 U.S.C. § 119(e) to U.S. Provisional Patent Application Ser. No. 63/620,545 filed on Jan. 12, 2024, which is incorporated herein in its entirety by reference.

FIELD

The present disclosure generally relates to the manufacture and sealing of metallic and glass containers, and more specifically to an apparatus and methods used to seal metallic and glass containers with Roll-on Pilfer Proof (ROPP) closures and pre-threaded metallic closures.

BACKGROUND

Metallic containers offer distributors and consumers many benefits. The metallic body of a metallic container provides optimal protection properties for products. For example, the metallic body prevents CO2 migration and transmission of UV radiation, which may damage the contents of the metallic container and negatively influence the effectiveness of the ingredients, as well as the flavor, appearance, or color of the product. Metallic containers also offer an impermeable barrier to light, water vapor, oils and fats, oxygen, and micro-organisms and keep the contents of the metallic container fresh and protected from external influences, thereby guaranteeing a long shelf-life.

The increased durability of metallic containers compared to glass containers reduces the number of containers damaged during processing and shipping, resulting in further savings. Additionally, metallic containers are lighter than glass containers of comparable size, resulting in energy savings during shipment. Further, metallic containers can be manufactured with high burst pressures which make them ideal and safe for use as containers holding products under pressure, such as carbonated beverage containers. Glass containers are often not allowed in certain locations, e.g., parks, beaches, pools, etc., thus making metal or plastic containers preferred.

Additionally, many consumers prefer metallic containers over glass or plastic containers. Metallic containers are particularly attractive to consumers because of the convenience they offer. The light weight of metallic containers makes them easier to carry than glass containers. Metallic containers are particularly suitable for use in public places and outdoors because they are more durable than glass containers. Further, some consumers avoid plastic containers due to concerns that the plastic may leach chemicals into consumable products.

Many consumers avoid plastic containers due to environmental concerns because few plastic containers can be and are recycled. Therefore, environmentally conscious consumers prefer metal containers because they are easier to recycle than glass or plastic containers. Moreover, environmentally conscious consumers prefer to not use plastic containers because they often end up in landfills and chemicals in the plastic containers can leach into the ground and drinking water.

The most important factors for today's consumer include convenience and recyclability. The Alumi-Tek® metal bottle is an aluminum bottle crafted for the eco-conscious consumer who appreciates the circularity of aluminum as well as the portability and convenience of a 28 mm silhouette, 12-oz., 16-oz., or another sized bottle. Today's on-the-go consumers prefer the rich designs supported by Alumi-Tek® bottles for their favorite coffee brands, protein shakes, or bottled water.

The exterior surfaces of metallic containers are also ideal for decorating with brand names, logos, designs, product information, and/or other preferred indicia for identifying, marketing, and distinguishing the metallic container and its contents from other products and competitors. Thus, metallic containers offer bottlers, distributors, and retailers the ability to stand out at the point of sale.

To meet the high demand for metallic containers, metallic container manufacturing facilities operate some of the fastest, if not the fastest, production lines in the container industry. Because of the high speeds of the production lines, techniques or processes that may work in other industries or with containers formed of other materials do not necessarily work at the high speeds required for metallic container production lines. Accordingly, specialized equipment and techniques are often required for many of the operations used to form and seal metallic containers.

Metallic beverage containers come in a variety of shapes and sizes. Some metallic beverage containers have a bottle shape. Metallic bottles typically include a closed bottom portion, a generally cylindrical body portion, a neck portion with a reduced diameter extending upwardly from the body portion, and an opening positioned on an uppermost portion of the neck portion. After being filled with a beverage or other product, metallic bottles are typically sealed with a roll-on-pilfer proof closure ("ROPP"), although other closures, such as twist-off crown caps and roll-on closures without a pilfer proof feature, may be used. Methods and apparatuses of forming a threaded neck on a metallic bottle to receive a ROPP closure are described in U.S. Patent Application Publication No. 2014/0263150 and U.S. Patent Application Publication No. 2014/0298641, which are each incorporated herein by reference in their entireties. Methods and apparatuses for capping and sealing metallic bottles, specifically apparatuses and methods used to seal metallic bottles with ROPP closures, are disclosed in U.S. Patent Application Publication No. 2018/0044155 and U.S. Pat. No. 11,459,223, which are each incorporated herein by reference in their entireties.

The Alumi-Tek metallic bottle currently uses a metallic screw top cap, which can be a ROPP closure. As discussed herein, using a metallic cap on a metallic bottle can present challenges when sealing a pressurized beverage in the metallic bottle.

Referring now to FIGS. 1A-1D, several actions must occur to generate and maintain an effective seal between a metallic bottle 2 and a ROPP closure 10. As shown in FIGS. 1A-1B, a ROPP shell 9 with an unthreaded body portion 12A is placed on the neck portion 5 of the metallic bottle 2. The ROPP shell 9 covers the bottle threads 8. A pilfer band 18 of the ROPP shell 9 extends downward past a skirt 30 of the metallic bottle 2.

Referring now to FIG. 1C, a capping apparatus 22 subsequently performs three operations: (1) reforming a top portion 20 of the ROPP closure 10 to form a reform or channel 32; (2) forming threads 16 on a portion of the closure body 12; and (3) tucking the pilfer band 18 against the metallic bottle 2. The timing and sequence of these three actions varies between different prior art capping apparatuses 22. Generally, one or more of a pressure block ejector 24 and a pressure block 25 apply a load, or "topload," to the top portion 20 of the ROPP closure 10 to press an outer edge of the top portion 20 down around a curl 6 of the metallic bottle 2 creating a reform or channel 32. An interior surface of the channel 32 applies force to a liner 14 within the ROPP closure 10. Accordingly, the liner 14 contacts a top and an exterior of the bottle curl 6 to form an effective seal.

Once sealed, closure threads 16 are formed on the ROPP closure 10 to maintain the seal after the pressure block ejector 24 and the pressure block 25 are removed. The closure threads 16 are formed by a thread roller 26 that applies a "sideload" to the closure body 12. Typically, two thread rollers 26 are used. The thread rollers 26 use the underlying bottle threads 8 as a mandrel. The closure threads 16 are formed as the thread rollers 26 press against and wind down the closure body portion 12 along the bottle threads 8.

Two pilfer rollers 28 tuck the bottom edge of the ROPP closure 10 against a protrusion, known as the skirt 30, of the metallic bottle 2. In this manner, if the ROPP closure 10 is rotated in an opening direction, the pilfer band 18 is severed to provide visual evidence of tampering. The pilfer rollers 28 also apply a sideload to the metallic bottle 2 to tuck the pilfer band 18 against the bottle skirt 30. In some cases, a metallic bottle 2 may be sealed by a Roll On (RO) closure that does not include a "pilfer proof" feature. An example of a neck portion 5 of a metallic bottle 2 sealed by a ROPP closure 10 is illustrated in FIG. 1D.

The metal ROPP closure 10 includes an aluminum shell that is custom formed to the pre-threaded bottle 2 to generate closure threads 16. This metal is substantially thick to enable the closure threads 16 to resist closure blowoff at high pressure (e.g., greater than 100 psi). All currently known ROPP closures that could be used for capping Alumi-Tek metal bottles utilize a low durometer flat or shaped polymer material 14 to generate a seal between the ROPP closure 10 and the metallic bottle 2. Unfortunately, the thick metal of the ROPP closure 10 and the seal material 14 require a substantial topload (e.g., about 220 lbs) to "reform" tightly against a mating geometry of the bottle curl 6 to make the seal. The combination of the required topload applied by the pressure block ejector 24 and the pressure block 25 and the forming loads applied by the thread roller 26 and the pilfer roller 28 prevents reductions in the thickness and/or weight of the metallic bottle 2 and the ROPP closure 10 from being reduced in thickness and/or weight because a thinner and/or lighter metallic bottle 2 will collapse when the topload is applied to the metallic bottle and the ROPP closure during the sealing and thread forming process.

The method of sealing metallic bottles 2 already deviates from the method of sealing a classic glass bottle with a ROPP closure in that the method of sealing metallic bottles uses a two-pass threading/capping process versus the single pass threading/capping process used with glass bottles. Two passes are needed for the metallic bottles 2 in order to use less load and prevent the metallic bottle from buckling or collapsing and prevent the neck from buckling or being crushed. Reducing the thickness and/or weight of the container (including the metallic bottle and/or closure) is achieved by lightweighting the container, which reduces the material used to make the container, reduces the cost to make the container, and increases the sustainability of the container. Additionally, reducing the number of passes during the sealing process required to form the threads on the metallic closure from two or three passes down to one single pass reduces the manufacturing time and cost.

Further, capping apparatus 22 designed to seal a metallic bottle 2 with a ROPP closure 10 using two or more passes of the thread roller 26 are expensive. Reducing the top load required to seal a metallic bottle with a ROPP closure would beneficially permit the reduction in the thickness of the metal of the metallic bottle, and would save bottlers the cost of purchasing specialized capping apparatus 22 configured to seal the metallic bottle with multiple passes of the thread rollers. Accordingly, reducing the top load required to seal a metallic bottle would have many benefits, including reductions in the thickness of metallic bottles, reduced manufacturing costs of metallic bottles, and reduced equipment costs for bottlers. Further, reducing the top load may also permit the use of increased side loads to generate deep threads in a single pass, permitting the use of single pass capping apparatus.

SUMMARY

Due to the limitations associated with the prior art described above, an aspect of the following disclosure is an improved metallic ROPP closure or an improved pre-threaded or pre-lugged metallic closure that employs a floating liner with at least one engagement element, such as a plug seal, alignment support, bumper, or the like. The improved metallic ROPP closure or improved pre-threaded or pre-lugged metallic closure is used with metallic bottles, metallic containers, glass bottles, and/or glass containers. Another aspect of the disclosure is an improved metallic bottle.

Typically the metallic closures discussed herein are unthreaded shells that are threaded after the containers are filled with their predetermined contents; however, the present floating liner, with at least one engagement element such as a plug seal, can be used on pre-threaded metallic closures, metallic closures with partial threads or lugs (e.g., thread components that do not extend around the entire circumference, for example as seen on caps for glass baby food jars), and metallic closures for glass or metal bottles/containers.

The new metallic bottle and/or metallic closure with a floating liner significantly reduces the need to reform the metallic closure and liner material to achieve the desired seal, which greatly reduces the amount of topload or force needed to form a seal between the metallic closure and the metallic bottle, and provides several benefits including: (i) a reduction in the total weight of the container (the metallic bottle and metallic closure); (ii) a reduction in the cost of the container; and (iii) improved package material efficiency, i.e., sustainability. Furthermore, the reduction in topload or force needed to form the seal may allow factories and plants to utilize the same capping apparatus for both metallic containers and glass containers as opposed to the separate equipment currently required to seal containers of different materials.

The significant reduction of topload or force needed to be applied to the top of the metallic closure when using a closure with a floating liner of the present disclosure was an unexpected result with significant benefits. The metallic closure with the floating also addresses concentricity limitations of other liners used in prior art ROPP closures.

One aspect of the present disclosure is to provide a metallic bottle and metallic closure with a floating liner that allows for alignment with the bore of the metallic bottle (i.e., a surface of the inner diameter of the bottle curl), while allowing the metallic closure to freely align to the bottle threads of the metallic bottle without creating stress on the liner or elements thereof. This is a major improvement over the prior art liners and seals secured to the metallic closure shell.

In some embodiments, the floating liner is formed of only one material. The material of the floating liner may be an elastic material such as a polymer or a hard, low-friction material, for example HDPE, LDPE, aluminum, or other material. With the floating liner formed of a hard, low-friction material, the torque required by the user to open the container (e.g., twisting off the metallic closure) would be lower than closures with softer elastomeric seals and/or liners.

In other embodiments, the floating liner comprises more than one material. For example, a first portion of the floating liner may comprise a first material and a second portion of the floating liner may comprise a second material. In at least one embodiment, the first and second materials may have different coefficients of friction and/or hardness to increase the seal strength and not require too much force from the user to open the container.

In at least one embodiment, the floating liner comprises a first material with a first durometer, and a second material with a second durometer that is less than the first durometer.

In one or more embodiments, the floating liner comprises an inner plug seal that comprises the second material.

In some embodiments, the inner plug seal is formed of the first material and the second material coats or covers at least an outer surface of the inner plug seal, the outer surface configured to contact an inner diameter surface of a curl of a metallic bottle.

In other embodiments, the inner plug seal consists of the second material.

In other embodiments, each of the engagement elements comprise at least a second material.

One advantage of the metallic closure with the floating liner is that the outer surface of the inner plug seal can have a diameter that is a large percentage of the diameter of the closure body. This is beneficial because the curl of the metallic bottle of the present disclosure may be formed such that the inner surface of the curl has a greater inner surface diameter than a prior art metallic bottle with a body portion of the same diameter. In this manner, one or more extra necking stages required to reduce the diameter of the conic between the upper bottle thread and the opening of the metallic bottle can be avoided. Forming the bottle curl with a greater inner surface diameter also saves metal material as less metal material is required to form the metallic bottle, reducing the cost of the metallic bottle and increasing sustainability.

It is another aspect of the disclosure to provide a threaded closure with at least one channel formed through the closure threads formed on the closure body. The channel is adapted to provide fluidic communication from an interior of the metallic bottle to ambient air when the threaded closure is rotated to remove the threaded closure from the opening of the metallic bottle. The pressure is released before the closure threads lose thread engagement with the container threads to prevent unintended expulsion of the threaded closure from the opening of the metallic bottle.

Another aspect of the disclosure is to provide a metallic ROPP closure with one or more fluid flow-through elements, such as vents, to perform the functionality of the above-mentioned channel.

One aspect includes providing a metallic bottle sealed with a metallic closure that has a liner configured to form the seal, the liner positioned between a curl of the metallic bottle and the metallic closure. In some embodiments, the liner may be formed from a wad of material that is at least partially impervious to gas and liquids (hereinafter "wad"). Optionally, the material of the wad may be similar to a compressible crown sealing material. Alternatively, the material of the wad may be a high durometer and/or flexible material that is not compressible. In some embodiments, the wad may allow an amount of oxygen into the metallic bottle. The wad may be positioned on the interior and/or lower surface of the metallic closure before the metallic closure is inserted onto the curl and neck of the metallic bottle.

In some embodiments, after positioning the wad in the closure shell, a mold is placed into the closure shell to form the shape of the liner. For example, the mold may form one or more engagement elements (or features) on the liner, such as one or more of an inner plug seal, an upper bumper, and an outer alignment support. Thereafter, the metallic closure with the liner is positioned on the top of the metallic bottle.

In at least some embodiments, no adhesives are used to attach the liner (including the liner formed from the wad) to the metallic closure. In this manner, the liner may move laterally relative to the metallic closure to adjust the position of the liner to account for a curl that is not concentrically formed on a metallic bottle.

In some embodiments, the seal between the metallic bottle and the metallic closure is formed by a combination of both the wad and one or more engagement elements comprising, an inner plug seal, an outer seal (or outer alignment support), and/or an upper bumper of the metallic closure that contact one or more surfaces of the metallic bottle, typically the curl.

In various embodiments, the liner comprises a bead of a liquid sealant that is at least partially impervious to gas and liquids. Optionally, the liquid sealant is applied to contact surfaces of the metallic bottle (such as its curl) or the metallic closure before the metallic closure is positioned on the curl and neck of the metallic bottle. After the metallic closure is positioned onto the metallic bottle, the liquid sealant flows between the contact surfaces of the metallic bottle and the metallic closure, substantially filling the spaces. The liquid sealant may then harden to create a seal or the liquid sealant may set as an elastic material.

An advantage of the floating liner with a plug seal in the metallic closure is that the metallic closure does not have to be reformed on the outer perimeter as required in prior art closures to tightly compress the prior art liner against an outer diameter of the curl of the prior art metallic bottle and the interior of the prior art closure. Specifically, no pressure block is needed to apply a predetermined topload force to a portion of the top portion (specifically the perimeter) of the metallic closure of the present disclosure to form the reform or closure channel required by prior art ROPP closures.

Some force, for example a plug insertion force, will be needed to press the metallic closure downwardly such that the inner plug seal will be pressed downwardly relative to the inner diameter surface of the curl, but a closure channel does not need to be formed around the perimeter of the metallic closure once it is positioned in a sealing position on the metallic bottle. The plug insertion force is the force required to push the flexible inner plug seal of the floating liner of the metallic closure into an interference fit with the inflexible inner diameter surface of the curl of the metallic bottle.

In some prior art threaded metallic closures, a significant topload was required to bend the metal and liner materials during the reforming step. However, the current industry standard topload is not required with the floating liner with the plug seal of the present disclosure.

The floating liner with a plug seal may be used in a pre-threaded metallic closure, which similarly would not require topload to seal a metallic bottle. With a pre-threaded metallic closure, torque would be used to secure the metallic closure onto the metallic bottle to form a sealed container. Thus, the downward force created by torquing the pre-threaded metallic closure onto the metallic bottle would create the plug insertion force.

Prior art, industry standard, ROPP closures need about 220 lbs of topload to securely close the metallic closure onto the metallic bottle. Embodiments of the present disclosure significantly reduce the amount of topload needed. For example, less than 150 lbs of topload is needed to securely close the metallic closure of embodiments of the present disclosure onto the metallic bottle. In some embodiments, less than 100 lbs of topload is needed to securely close the metallic closure onto the metallic bottle. In various embodiments, less than 50 lbs of topload (or plug insertion force) is needed to securely close the metallic closure onto the metallic bottle. In some embodiments, less than 25 lbs of topload (or plug insertion force) is needed to securely close the metallic closure onto the metallic bottle. In various embodiments, less than 10 lbs of topload (or plug insertion force) is needed to securely close the metallic closure onto the metallic bottle.

In various embodiments described herein, a metallic closure which is threaded is provided with a fluid flow-through feature, such as transverse channels formed through the closure threads. These fluid flow-through features enable controlled venting of the metallic container when the threaded metallic closure is removed from the metallic bottle. When the seal between the metallic closure and the metallic bottle is broken, these elements allow compressed gas to escape from the interior of the metallic container to ambient air pressure before the closure threads lose thread engagement with the bottle threads of the metallic bottle. Thus, these fluid flow-through features may prevent the metallic closure from being forcefully ejected from the metallic bottle during removal of the metallic closure by compressed gas within the metallic bottle and also allow for easy removal of the metallic closure. In alternative or additional embodiments, functionally equivalent features may provide this capability, such as vents at the top of the metallic closure.

Another aspect of embodiments of the present disclosure is a method for manufacturing a metallic bottle and a metallic closure with a floating liner having an inner plug seal. In some embodiments, a liner with an inner plug seal is formed in a plastic molding machine. The metallic (preferably aluminum, or alloy thereof) closure shell is formed concurrently and/or separately. Next the closure shell is held while the floating liner is placed in the closure shell.

In some embodiments, vent features are formed in the closure shell by forming an aperture in (or through) a body portion of the closure shell. The vent features may be formed with a portion of closure shell bent inwardly to form a retaining element to selectively engage and retain the liner in the closure shell.

Additionally, or alternatively, a plurality of retaining elements may be formed in the closure shell. The retaining elements comprise a portion of the closure shell that is pressed or bent inwardly. In this manner, an inner diameter formed by innermost portions of the plurality of retaining elements is less than the inner diameter of the closure body. Further, the inner diameter formed by the plurality of retaining elements is less than an outer diameter of the floating liner such that the floating liner is retained within the closure body and prevented from unintended or inadvertent separation from the metallic closure.

In some embodiments, one or more of the retaining elements comprise a piece of metal of the closure shell bent inwardly when a vent feature is formed. Additionally, or alternatively, one or more of the retaining elements may comprise a convex portion of the closure shell pressed inwardly without piercing the closure shell.

In at least one embodiment, the vent features and/or the retaining elements are formed in the closure shell and then the floating liner is pressed into the closure shell past the retaining elements.

Alternatively, in other embodiments, the floating liner is positioned within the closure shell before one or more of the vent features and/or the retaining elements are formed.

Another aspect of embodiments of the present disclosure is a method for manufacturing a metallic bottle and a metallic closure with a floating liner having a plug seal. In some embodiments, a metallic closure shell is formed of a metallic material, preferably aluminum or an alloy thereof. Then the formed closure shell is held while a wad of molten polymer is placed into the closure shell. A mold tool is then lowered into the closure shell to compress the wad into a desired shape, e.g., to form a floating liner with one or more engagement element, such as an outer alignment support, an inner plug seal, or an upper bumper positioned between the inner plug seal and the outer alignment support. The closure shell and mold are cooled to solidify the polymer. The mold tool is then removed leaving a floating liner having at least one engagement element in the closure shell.

In some embodiments, after the floating liner is formed, fluid flow-through features (such as vents) are formed in the closure shell by forming an aperture in (or through) a body portion of the closure shell. The vents may be formed with a portion of closure shell bent inwardly to form a retaining element to selectively engage and retain the floating liner in the closure shell.

Additionally, or alternatively, a plurality of retaining elements are formed in the closure shell. The retaining elements comprise a portion of the closure shell that is pressed or bent inwardly. In this manner, an inner diameter formed by innermost portions of the plurality of retaining elements is less than the inner diameter of the closure body. Further, the inner diameter formed by the plurality of retaining elements is less than an outer diameter of the floating liner such that the floating liner is retained within the closure body and prevented from unintended or inadvertent separation from the metallic closure.

In some embodiments, one or more of the retaining elements comprise a piece of metal of the closure shell bent inwardly when a vent feature is formed. Additionally, or alternatively, one or more of the retaining elements may comprise a convex portion of the closure shell pressed inwardly without piercing the closure shell.

In some embodiments, the vent features cannot be formed in the closure shell before forming the floating liner in the closure shell because forming the vent features and retaining elements before molding the floating liner would cause an interference with the molding components that form the outer alignment element of the floating liner. This in-shell liner molding method requires that the liner/seal material and the metallic shell lacquer material do not form a permanent bond such that the liner is floating and the non-concentric benefits can be realized, specifically lateral movement of the liner relative to the closure shell such that the floating liner can move to adjust for a curl of the metallic bottle that is not concentric with a body portion of the metallic bottle. Specifically, the opposite of the prior art must be true: if heat is applied to the metal, care must be taken such that a heat seal adhesive is not formed and/or does not cause a bond between the closure shell lacquer and floating liner.

Another advantage of the present disclosure over the prior art is that an unthreaded metallic shell closure can support more thread/pilfer roller sideload since the metallic bottle is no longer supporting a high topload during the sealing process. In other words, without the high topload previously required to seal metallic bottles with prior art metallic closures, a higher/larger sideload can be applied to the metallic bottle and metallic closure by the thread rollers and the pilfer rollers without causing the metallic bottle to collapse. Accordingly, the required thread depth of the closure threads and the tucking of the pilfer band against the bottle skirt can be achieved with a single pass capper (i.e., a capper with one or more thread rollers that form the closure threads in a single pass and with one or more pilfer rollers that tuck the pilfer band in one pass). Therefore, the higher thread/pilfer roller sideload allows the complete thread depth/pilfer form to be formed in a single pass (as is done for metallic closures on glass containers) instead of the standard two or three passes (as is done for metallic closures on metallic bottles). Moreover, by reducing the topload applied by the capping apparatus to a metallic bottle, the sideload applied by the thread rollers may optionally be increased to form deep threads in a single pass without risk of damage to the metallic bottle.

A single pass capper also permits the metallic bottles and/or metallic closures of the present disclosure to be threaded and sealed on customers' existing single pass cappers. The majority of ROPP cappers in the world are for glass containers (permitting high sideload) and these cappers are single pass cappers. The single pass cappers are much more common than the two-pass (or three-pass) cappers typically used to seal a prior art metallic bottle with a prior art ROPP closure. Customers must purchase a two-pass (or three-pass) capper instead of using an existing single-pass capper if the customer wants to fill a prior art metallic bottle and seal it with a prior art ROPP closure because the two-pass (or three-pass) capper separates the timing of the application of side-loads to avoid damaging the metallic bottle and/or the ROPP closure.

Further example aspects of the present disclosure include: a closure for sealing a metallic bottle, comprising: (1) a closure shell, comprising: (a) a top portion with an upper surface that is generally circular and a lower surface opposite the upper surface; (b) a closure body extending from the top portion; and (c) a plurality of retaining elements formed around a circumference of the closure body, each retaining element projecting inwardly toward a longitudinal axis extending through a center of the top portion; and (2) a floating liner positioned within the closure body proximate to the lower surface, the floating liner comprising: (i) a top surface that is generally circular, the top surface positioned proximate to the lower surface of the closure shell; and (ii) an inner plug seal extending away from the top surface, the top surface being movable relative to the lower surface such that the inner plug seal can move laterally relative to the longitudinal axis.

The closure may further comprise the plurality of retaining elements being configured to retain the floating liner within the closure body.

In one or more embodiment, the retaining elements are configured to retain the floating liner within the closure body without preventing or constraining lateral movement of the top surface of the floating liner relative to the lowers surface of the closure shell to facilitate movement of the inner plug seal.

The closure may include one or more of the previous embodiments, and in some embodiments the floating liner comprises a polymer material.

Optionally, the closure may include one or more of the previous embodiments, and in at least one embodiment the floating liner is formed of a first material and a second material coats at least a portion of the inner plug seal.

In some embodiments, the second material coats at least an outer surface of the inner plug seal.

The closure may include one or more of the previous embodiments, and in one or more embodiment the floating liner is formed of a first material and the inner plug seal is formed of a second material.

In at least one embodiment, the second material is a polymer material or an elastomeric material that is different from the first material.

The closure may include one or more of the previous embodiments, and optionally the first material has a first hardness of a first durometer and the second material has a second hardness of a second durometer that is less than the first durometer.

The closure optionally includes one or more of the previous embodiments, and in some embodiments the closure shell is unthreaded.

Optionally, at least a portion of the unthreaded closure body is configured to be threaded when the closure is used to seal the metallic bottle.

The closure may include one or more of the previous embodiments, and in one or more embodiment the closure shell comprises closure threads formed before the closure is used to seal the metallic bottle.

The closure may optionally include one or more of the previous embodiments, and in some embodiments the closure shell comprises a plurality of lugs configured to retain the closure on the metallic bottle when the closure is used to seal the metallic bottle.

The closure may include one or more of the previous embodiments, and in at least one embodiment the top surface of the floating liner is not attached or affixed to the lower surface of the closure shell.

The closure may include one or more of the previous embodiments, and optionally the floating liner further comprises an outer alignment support extending away from the top surface.

In at least some embodiments, the outer alignment support is positioned outward of the inner plug seal (or further from the longitudinal axis than the inner plug seal) such that a curl of the metallic bottle is positioned between the inner plug seal and the outer alignment support when the closure is used to seal the metallic bottle.

Additionally, or alternatively, the closure may include one or more of the previous embodiments, and may further comprise an upper bumper positioned outward of the inner plug seal (or further from the longitudinal axis than the inner plug seal). The upper bumper is configured to selectively contact an upper surface of the curl of the metallic bottle when the closure is used to seal the metallic bottle.

In some embodiments, when the floating liner includes the outer alignment support, the upper bumper is positioned between the inner plug seal and the outer alignment support.

The closure may optionally include one or more of the previous embodiments, and in some embodiments the closure shell is formed of a metallic material.

In at least one embodiment, the metallic material is an aluminum alloy.

The closure may include one or more of the previous embodiments, and in at least one embodiment, a maximum outer diameter of the floating liner is greater than a minimum interior diameter of the closure body defined by the plurality of retaining elements.

The closure may include one or more of the previous embodiments, and in at least one embodiment, the upper surface of the closure shell has an outer diameter that is greater than the maximum outer diameter of the floating liner.

The closure optionally includes one or more of the previous embodiments, and an outer edge of the floating liner that defines the maximum outer diameter is spaced from an interior surface of the closure body.

In one or more embodiments, the maximum outer diameter of the floating liner is less than an interior diameter of the closure body measured proximate to the top portion of the closure shell.

Another aspect of the disclosure is a threaded metallic bottle, comprising: (1) a body portion having a sidewall extending upwardly from a closed bottom; (2) a neck portion extending upwardly from the sidewall; (3) container threads formed on at least a portion of the neck portion, the container threads having a thread root diameter; and (4) a curl at an uppermost portion of the neck portion, the curl defining an open end opposite the closed bottom, the curl having a maximum outer curl diameter that is at least about 90% of the thread root diameter.

Optionally, an inner surface of the curl is substantially linear when viewed in cross-section In at least one embodiment, the inner surface of the curl is substantially parallel to a longitudinal axis of the threaded metallic bottle.

The threaded metallic bottle may optionally include one or more of the previous embodiments, and in at least one embodiment the curl has an outer surface that is substantially linear when viewed in cross-section.

In some embodiments, the outer surface is substantially parallel to the longitudinal axis.

The threaded metallic bottle may optionally include one or more of the previous embodiments, and in at least one embodiment, the maximum outer curl diameter is at least about 95% of the thread root diameter.

In some embodiments, the maximum outer curl diameter is at least about 97% of the thread root diameter.

In at least one embodiment, the maximum outer curl diameter is at least about 98% of the thread root diameter.

The threaded metallic bottle may optionally include one or more of the previous embodiments, and in one or more embodiment, the maximum outer curl diameter is between about 1.2 inch and 1.4 inch.

Alternatively, in other embodiments, the maximum outer curl diameter is between about 1.3 inch and 1.38 inch.

In one or more embodiments, the maximum outer curl diameter is about 1.351 inch.

The threaded metallic bottle may optionally include one or more of the previous embodiments, and in at least one embodiment, a difference between the maximum outer curl diameter and the thread root diameter is less than about 0.035 inch.

Alternatively, in other embodiments, the difference between the maximum outer curl diameter and the thread root diameter is less than about 0.031 inch.

In some embodiments, the difference between the maximum outer curl diameter and the thread root diameter is less than about 0.029 inch.

In one or more embodiments, the difference between the maximum outer curl diameter and the thread root diameter is about 0.026 inch.

Optionally, the threaded metallic bottle includes one or more of the previous embodiments, and in some embodiments, the curl has an inner surface with an interior diameter of between about 0.9 inch and 1.5 inch.

In other embodiments, the interior diameter of the inner surface of the curl is between about 1.15 inch and 1.35 inch.

In at least one embodiment, the interior diameter of the inner surface of the curl is about 1.245 inch.

Yet another aspect of the disclosure is a metallic bottle with a selectively removable closure, comprising: (1) the closure, comprising: (a) a top portion with an upper surface and a lower surface opposite the upper surface; (b) a closure body extending from the top portion; and (c) a plurality of retaining elements formed around a circumference of the closure body, each retaining element projecting inwardly toward a longitudinal axis extending through a center of the top portion; (2) a floating liner positioned within the closure body proximate to the lower surface, the floating liner comprising: (i) a top surface that is generally circular, the top surface facing the lower surface of the closure, and the top surface of the floating liner not attached to the lower surface to permit movement of the floating liner relative to the lower surface; and (3) an inner plug seal extending away from the top surface, the inner plug seal being movable laterally relative to the longitudinal axis, and the plurality of retaining elements configured to retain the floating liner within the closure body; and (3) the metallic bottle, comprising: (a) a body portion having a sidewall extending upwardly from a closed bottom; (b) a neck portion extending upwardly from the sidewall; (c) container threads formed on at least a portion of the neck portion; and (d) a curl at an uppermost portion of the neck portion, the curl defining an open end opposite the closed bottom, the inner plug seal of the floating liner configured to contact an inner surface of the curl to seal the metallic bottle.

In some embodiments, the inner surface of the curl is substantially linear when viewed in cross-section.

In at least one embodiment, and the inner surface is substantially parallel to the longitudinal axis extending through the center of the closure.

The metallic bottle may optionally include one or more of the previous embodiments, and in some further embodiments the curl has an outer surface that is substantially linear when viewed in cross-section.

The metallic bottle optionally includes one or more of the previous embodiments, and in some embodiments the container threads have a thread root diameter and the curl has an outer surface with a maximum outer curl diameter, and the maximum outer curl diameter is at least about 95% of the thread root diameter.

The metallic bottle may optionally include any one or more of the previous embodiments, and in some embodiments the floating liner further comprises an outer alignment support extending away from the top surface, In at least one embodiment, the outer alignment support is positioned outward of the inner plug seal such that the curl is positioned between the inner plug seal and the outer alignment support.

Example aspects of the present disclosure include: a metallic end closure for sealing a container comprising: a metallic closure shell having a substantially flat upper surface, a substantially flat lower surface opposite the upper surface, a perimeter edge extending from the upper surface to the lower surface, and an outer perimeter wall connected to the perimeter edge and extending substantially perpendicular to the substantially flat upper surface; a free floating liner positioned proximate to the substantially flat lower surface and within the perimeter edge, wherein the free-floating liner is not attached to the substantially flat lower surface, the free-floating liner comprising: a substantially flat circular portion; and an inner plug seal extending substantially perpendicular from the substantially flat circular portion; and a plurality of retaining elements configured to hold the free floating liner in the metallic closure shell.

Any of the aspects herein, wherein the free-floating liner further comprises an outer alignment support extending outwardly from the substantially flat circular portion and positioned radially outward from the inner plug seal.

Any of the aspects herein, wherein the free-floating liner further comprises an upper bumper positioned between the inner plug seal and the outer alignment support.

Still another aspect of the disclosure is a method of applying a closure to a metallic bottle, comprising: (1) providing the metallic bottle, comprising: (a) a body portion having a sidewall extending upwardly from a closed bottom; (b) a neck portion extending upwardly from the sidewall; (c) container threads formed on at least a portion of the neck portion; and (d) a curl at an uppermost portion of the neck portion, the curl defining an open end opposite the closed bottom; (2) providing the closure, comprising: (i) a top portion with an upper surface and a lower surface opposite the upper surface; (ii) a closure body extending from the top portion; (iii) a plurality of retaining elements formed around a circumference of the closure body, each retaining element projecting inwardly; and (iv) a floating liner positioned within the closure body proximate to the lower surface, the floating liner comprising: (a) a top surface that is generally circular, the top surface facing the lower surface of the closure shell, wherein the top surface of the floating liner is movable relative to the lower surface; and (b) an inner plug seal extending away from the top surface, and wherein the plurality of retaining elements retain the floating liner within the closure body; (3) positioning the metallic closure on the metallic bottle such that the inner plug seal of the floating liner is positioned adjacent to and touching an inner surface of the curl, wherein the floating liner slides within the closure body to align concentrically with the curl of the metallic bottle; and (4) applying a topload to the upper surface of the metallic closure, wherein the topload is less than 100 lbs.

In at least one embodiment, the topload is less than 25 lbs.

In one or more embodiment, the topload is less than 10 lbs.

Various methods of forming a container and a metallic closure with a floating liner are provided. Example aspects of the various methods include a method of Any of the aspects herein, wherein the topload is less than 220 lbs.

Any of the aspects herein, wherein the topload is less than 150 lbs.

Any of the aspects herein, wherein the topload is less than 100 lbs.

Any of the aspects herein, wherein the topload is less than 50 lbs.

Any of the aspects herein, wherein the topload is less than 25 lbs.

Any of the aspects herein, wherein the topload is less than 10 lbs.

Any of the aspects herein, wherein the threaded neck portion of the metallic bottle comprises one or more continuous threads or a plurality of non-continuous threads/lugs.

For purposes of further disclosure, the following references generally related to ROPP closures, inverse ROPP closures, and seals for metallic containers are hereby incorporated by reference in their entireties:

U.S. Pat. No. 11,130,606 issued to Ross on Sep. 28, 2021; and

U.S. Pat. No. 10,040,593 issued to Ross on Aug. 7, 2018.

Although generally referred to herein as "metallic container," "metal container," "metallic bottle," "metal bottle," "beverage container," "container," and/or "bottle," it should be appreciated that the current disclosure and embodiments herein may be used with containers of any size or shape including, without limitation, beverage cans and beverage bottles. Accordingly, the term "container" is intended to cover containers of any type.

Similarly, the term "closure" is intended to cover closures of any type for closing a food or beverage container and includes closures of any size or shape including, without limitation, closures for beverage cans and beverage bottles. The term closure includes metallic closures, Roll on Pilfer Proof (ROPP) closures, pre-threaded closures, and closures with or without pilfer bands.

"Threaded closures" specifically refer to closures with threads that threadingly engage threads on a bottle, can, or other container.

Further, as will be appreciated by one of skill in the art, although the methods and apparatus of the present disclosure are generally related to metallic containers, metallic closures, and metallic bottles, the methods and apparatus of the present invention are not limited to metallic containers and closures and may be used to form containers and closures of any material, including without limitation aluminum (or alloys thereof), steel, tin (or alloys thereof), plastic, glass, paper, or any combination thereof.

The term "threads" as used herein refers to any type of helical structure used to convert a rotational force to linear motion. Threads may be symmetric or asymmetric, of any predetermined size, shape, or pitch, and may have a clockwise or counterclockwise wrap. Threads may be formed on straight or tapered portions of a metallic container or a threaded closure and the threads may comprise one or more leads. Additionally, it will be appreciated by one of skill in the art, that both helical threads and lug threads may be used with metallic or glass containers and threaded closures of the present disclosure. Any type of threads known to those of skill in the art may be formed on a metallic closure or a metallic bottle of the present disclosure. Accordingly, a metallic closure or a metallic bottle of embodiments of the disclosure may comprise helical threads, partial threads, lug threads, threads with fluid flow-through features, and the like.

The terms "floating liner" and "free-floating liner" can be used interchangeably and refer to a liner that can move laterally within a closure to form a seal between the closure and a container.

The phrases "at least one," "one or more," "or," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C," and "A, B, and/or C" means A alone, B alone, C alone, A and B together, A and C together, B and C together, or A, B and C together.

Unless otherwise indicated, all numbers expressing quantities, dimensions, conditions, ratios, ranges, and so forth used in the specification and claims are to be understood as being modified in all instances by the term "about" or "approximately". Accordingly, unless otherwise indicated, all numbers expressing quantities, dimensions, conditions, ratios, ranges, and so forth used in the specification and claims can be increased or decreased by approximately 5% to achieve satisfactory results. In addition, all ranges described herein may be reduced to any sub-range or portion of the range, or to any value within the range without deviating from the invention.

As used herein, unless otherwise specified, the terms "about," "approximately," etc., when used in relation to numerical limitations or ranges, mean that the recited limitation or range may vary by up to 10%. By way of non-limiting example, "about 750" can mean as little as 675 or as much as 825, or any value therebetween. When used in relation to ratios or relationships between two or more numerical limitations or ranges, the terms "about," "approximately," etc. mean that each of the limitations or ranges may vary by up to 10%; by way of non-limiting example, a statement that two quantities are "approximately equal" can mean that a ratio between the two quantities is as little as 0.9:1.1 or as much as 1.1:0.9 (or any value therebetween), and a statement that a four-way ratio is "about 5:3:1:1" can mean that the first number in the ratio can be any value of at least 4.5 and no more than 5.5, the second number in the ratio can be any value of at least 2.7 and no more than 3.3, and so on.

The use of "substantially" in the present disclosure, when referring to a measurable quantity (e.g., a diameter or other distance) and used for purposes of comparison, is intended to mean within 5% of the comparative quantity. The terms "substantially similar to," "substantially the same as," and "substantially equal to," as used herein, should be interpreted as if explicitly reciting and encompassing the special case in which the items of comparison are "similar to," "the same as," and "equal to," respectively.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein. The use of "engaged with" and variations thereof herein is meant to encompass any direct or indirect connections between components.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the Summary, Brief Description of the Drawings, Detailed Description, Abstract, and Claims themselves.

These and other advantages will be apparent from this disclosure. The above-described embodiments, objectives, and configurations are neither complete nor exhaustive. The present disclosure is set forth in various levels of detail in the Summary as well as in the attached drawings and the Detailed Description and no limitation as to the scope of the present disclosure is intended by either the inclusion or non-inclusion of elements, components, etc. in this Summary. Additional aspects of the present disclosure will become clearer from the Detailed Description, particularly when taken together with the drawings.

As will be appreciated, other embodiments are possible using, alone or in combination, one or more of the features set forth above or described below. Further, the Summary is neither intended nor should it be construed as representing the full extent and scope of the present disclosure. As will be appreciated, other embodiments are possible using, alone or in combination, one or more of the features set forth above or described below. For example, it is contemplated that various features and elements shown and/or described with respect to one aspect, embodiment or figure may be combined with or substituted for features or elements of other aspects, embodiments or figures regardless of whether or not such a combination or substitution is specifically shown or described herein.

Any one or more aspects described herein can be combined with any other one or more aspects described herein. Any one or more features described herein can be combined with any other one or more features described herein. Any one or more embodiments described herein can be combined with any other one or more embodiments described herein.

BRIEF DESCRIPTION OF THE DRAWINGS

Those having skill in the art will recognize that the following description is merely illustrative of the principles of the invention, which may be applied in various ways to provide many different alternative embodiments. This description is made for illustrating the general principles of the teachings of this invention and is not meant to limit the inventive concepts disclosed herein.

The accompanying drawings, which are incorporated in and constitute a part of the specification, illustrate embodiments of the invention and together with the general description of the invention given above and the detailed description of the drawings given below, serve to explain the principles of the invention.

Figure 1B:
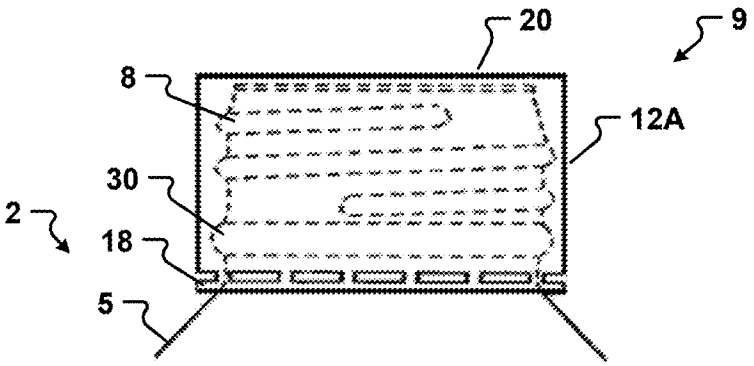
Fig. 1B (Prior Art)
FIG. 1B illustrates the ROPP shell positioned on the metallic bottle of FIG. 1A.
Figure 1A:
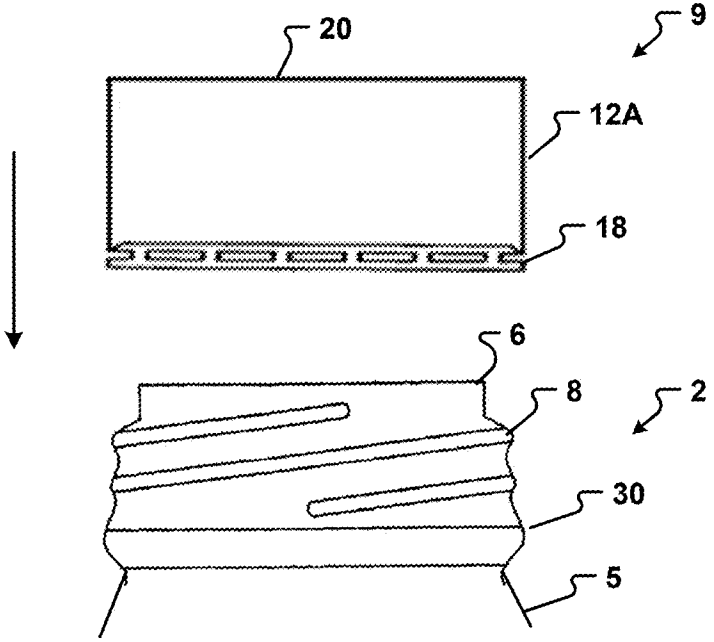
Fig. 1A (Prior Art)
FIG. 1A generally illustrates a ROPP shell and an unsealed prior art metallic bottle.

It should be understood that the drawings are not necessarily to scale, and various dimensions may be altered. In certain instances, details that are not necessary for an understanding of the invention or that render other details difficult to perceive may have been omitted. It should be understood, of course, that the invention is not necessarily limited to the particular embodiments illustrated herein.

The following is a listing of components according to various embodiments of the present disclosure, and as shown in the drawings:

| Number | Component |
|---|---|
| 2 | Metallic bottle |
| 3 | Body portion |
| 4 | Closed end portion |
| 5 | Neck portion |
| 5A | Conic portion |
| 6 | Curl |
| 6A | Inner curl diameter |
| 7 | Bottle opening |
| 8 | Bottle threads |
| 9 | ROPP shell |
| 10 | ROPP closure |
| 12 | Closure body |
| 12A | Unthreaded body portion |
| 14 | Liner |
| 16 | Closure Threads |
| 18 | Pilfer band |
| 20 | Top portion |
| 21 | Longitudinal axis |
| 22 | Capping apparatus |

-continued

| Number | Component |
|---|---|
| 24 | Pressure block ejector |
| 25 | Pressure block |
| 26 | Thread roller |
| 28 | Pilfer roller |
| 29 | Contact surface of pressure block |
| 30 | Skirt |
| 32 | Closure Channel (or reform) |
| 33 | Chuck |
| 34 | Holder |
| 35 | Point |
| 36 | Point |
| 37 | Point |
| 38 | Vertical contact region |
| 39 | Depth of closure channel |
| 40 | Metallic bottle |
| 41 | Neck portion |
| 42 | Bottle threads |
| 42A | Uppermost portion of bottle threads |
| 42-1 | Thread root |
| 43 | Closure |
| 44 | Top portion |
| 45 | Inner plug seal |
| 45B | Alternative plug seal |
| 46 | Outer alignment support |
| 47 | Upper bumper |
| 48 | Directionality of liner movement |
| 49 | Retaining elements |
| 50 | Curl |
| 50A | Non-concentric curl |
| 50B | Alternative curl shape |
| 51 | Floating Liner |
| 52A | Inner diameter of curl |
| 52B | Outer diameter of curl |
| 53 | Thread root diameter |
| 54 | Length of curl straight portion |
| 55 | Vents |
| 56 | Gas force arrows |
| 57 | Distance of potential inner plug seal movement |
| 58 | Distance of potential additional vertical movement |
| 59 | Distance of potential curl shift or liner movement |
| 60 | Outer diameter of bottle threads |
| 61 | Inner diameter surface of curl |
| 61A | Round inner diameter surface of curl |
| 61B | Non-concentric inner diameter surface of curl |
| 62 | Outer diameter surface of curl |
| 63 | Maximum outer diameter of plug seal |
| 64 | Bottle conic |
| 66 | Closure body portion |
| 68 | Upper surface of closure |
| 70 | Lower surface of closure |
| 72 | Top surface of liner |
| 73 | Bottom surface of liner |
| 74 | Circular portion of liner |
| 76 | Outer diameter of liner |
| 78 | Inner diameter defined by retention elements |
| 80 | Notch in outer alignment support |
| 82 | Closure threads |
| 84 | Plug seal length |
| 86 | Outer surface of inner plug seal |
| 88 | Length of linear portion of outer surface of inner plug seal |
| 90 | Curl receiving space |
| 92 | Width of curl receiving space |

DETAILED DESCRIPTION

To acquaint persons skilled in the pertinent arts most closely related to the present disclosure, a preferred embodiment that illustrates the best mode now contemplated for putting the invention into practice is described herein by, and with reference to, the annexed drawings that form a part of the specification. Exemplary embodiments are described in detail without attempting to describe all of the various forms and modifications in which the invention might be embodied. As such, the embodiments described herein are illustrative, and as will become apparent to those skilled in the arts, may be modified in numerous ways within the scope and spirit of the disclosure.

Although the following text sets forth a detailed description of numerous different embodiments, it should be understood that the legal scope of the description is defined by the words of the claims set forth at the end of this disclosure. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

Before any embodiments of the disclosure are explained in detail, it is to be understood that the disclosure is not limited in its application to the details of construction and the arrangement of components set forth in the following description or illustrated in the drawings. The disclosure is capable of other embodiments and of being practiced or of being carried out in various ways. Also, it is to be understood that the phraseology and terminology used herein is for the purpose of description and should not be regarded as limiting. Unless explicitly stated otherwise, the use or listing of one or more examples (which may be denoted by "for example," "by way of example," "e.g.," "such as," or similar language) is not intended to and does not limit the scope of the present disclosure.

Figure 2:
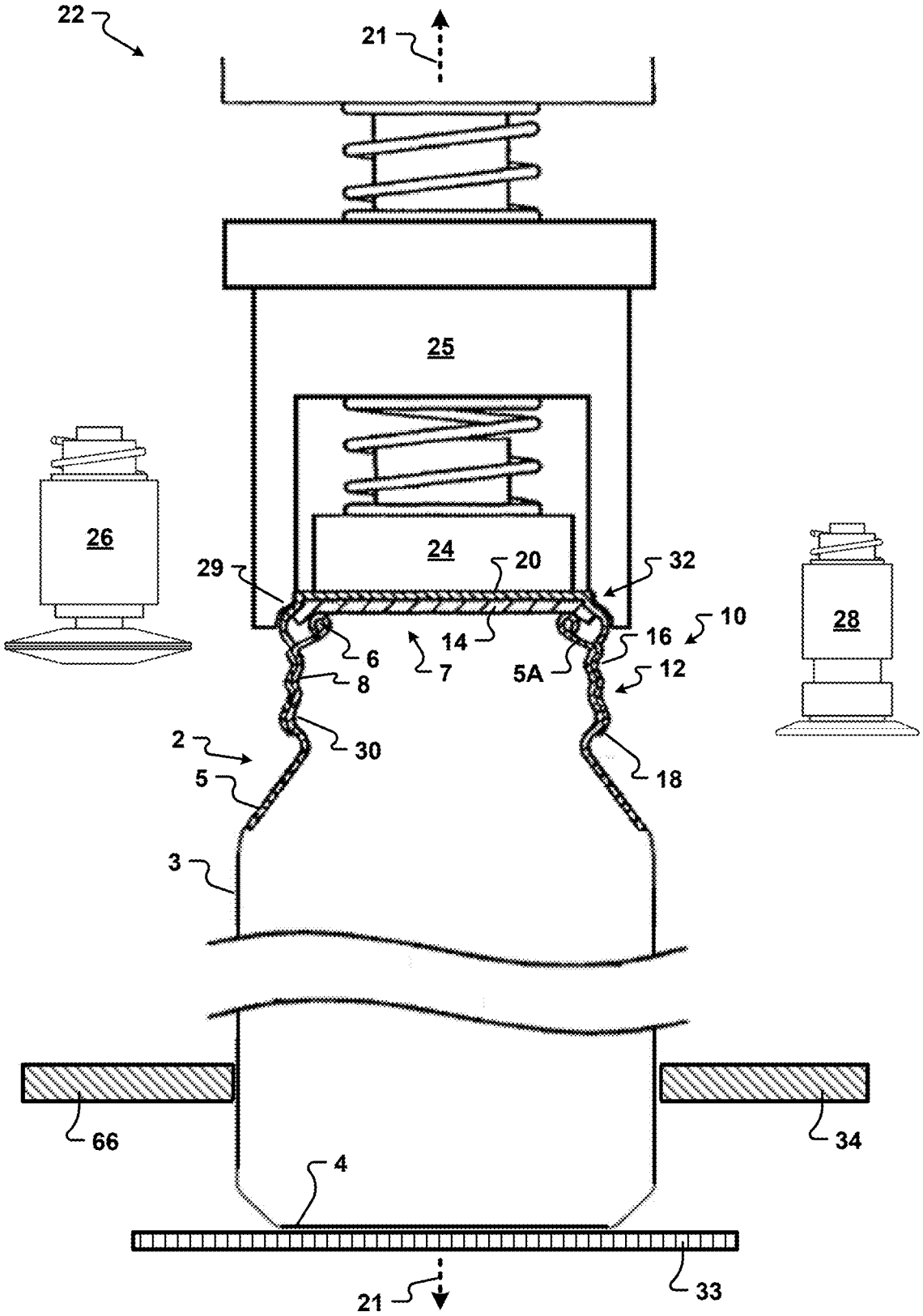
Fig. 2 (Prior Art)
FIG. 2 is a partial front elevation view of another prior art capping apparatus and it depicts a prior art metallic bottle sealed with a ROPP closure.

FIG. 2 shows a prior art capping apparatus 22, which generally includes a pressure block ejector 24, a pressure block 25 with a contact surface 29, two thread rollers 26 (with one being illustrated), and at least one pilfer roller 28. At least one of the pressure block ejector 24 and the pressure block 25 are configured to rotate axially around a longitudinal axis 21 of a metallic bottle 2. Optionally, the capping apparatus 22 may include from two to five thread rollers 26. Optionally, each of the thread rollers 26 may apply different sideload forces during the formation of the closure threads 16. Additionally, from one to five pilfer rollers 28 may be included with the capping apparatus 22.

Figure 1C:
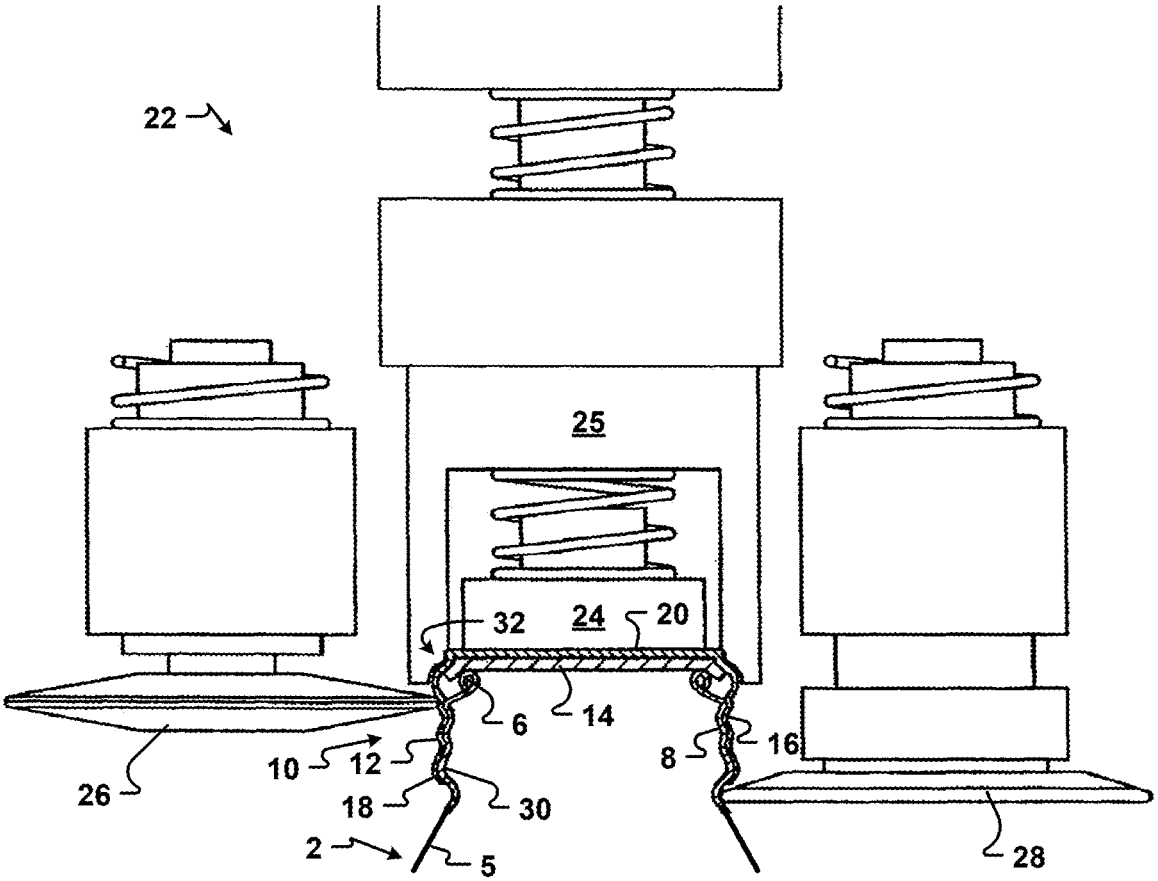
Fig. 1C (Prior Art)
FIG. 1C generally illustrates a method of sealing the metallic bottle with the ROPP shell of FIG. 1A using a prior art capping apparatus.

The capping apparatus 22 may be used to seal a metallic bottle 2 with a ROPP closure 10 that starts as a ROPP shell 9. The metallic bottle 2 can be the same as, or similar to, the prior art metallic bottle 2 illustrated in FIG. 1C. Alternatively, the metallic bottle 2 can be a light-weight metallic bottle formed of less, lighter, and/or different metallic material. In some embodiments, the lightweight metallic bottle 2 is sized to hold approximately 16 oz of a product and has a mass of less than about 25.4 g (about 0.896 ounce). Because metallic bottles of different sizes have different masses, larger metallic bottles (i.e., metallic bottles designed to hold more than 16 oz of contents) will have a maximum mass of more than 25.4 g (about 0.896 ounce). Similarly, smaller metallic bottles (i.e., metallic bottles designed to hold less than 16 oz of contents) will have a maximum mass of less than 25.4 g (about 0.896 ounce).

In some embodiments, the 16 oz light-weight metallic bottle 2 has a mass of less than about 23.25 g (about 0.820 ounce). Because metallic bottles of different sizes have different masses, larger metallic bottles (i.e., metallic bottles designed to hold more than 16 oz of contents) will have a maximum mass of more than 23.25 g (about 0.820 ounce). Similarly, smaller metallic bottles (i.e., metallic bottles designed to hold less than 16 oz of contents) will have a maximum mass of less than 23.25 g (about 0.820 ounce). However, if the metallic bottle is manufactured via impact extrusion, the bottle may be heavier than the aforementioned maximum masses.

The metallic bottle 2 is illustrated in FIG. 2 after being sealed by the capping apparatus 22 with a ROPP closure 10. The thread roller 26 and the pilfer roller 28 are illustrated in an optional disengaged position for clarity. The ROPP closure 10 may be formed from a prior art ROPP shell 9. The ROPP closure 10 generally includes a pilfer band 18 at a lowermost portion of a body portion 12, threads 16 formed on a portion of the body portion 12, a liner 14 positioned proximate to an interior surface of a top portion 20, and a channel 32 at a radial edge of the top portion 20.

In operation, the capping apparatus 22, ROPP closure 10, and metallic bottle 2 are brought into a predetermined alignment. In one embodiment, at least one of the pressure block ejector 24 and the pressure block 25 apply a predetermined topload force to at least a portion of an exterior surface of the closure top portion 20. The topload force at least partially compresses the ROPP liner 14 against the curl 6 to form and maintain a seal between the ROPP closure 10 and the metallic bottle 2. Said another way, the bottle curl 6 is at least partially embedded in the ROPP liner 14 by the topload force applied by the capping apparatus 22. However, it should be noted that no portion of the liner enters the interior of the metallic bottle 2 nor makes anything more than minimal incidental contact with the interior surface of the bottle curl 6.

The contact surface 29 of the pressure block 25 applies a predetermined topload force to a portion of the closure top portion 20 to form the closure channel 32. Generally, a depth 39 (illustrated in FIG. 3) of the closure channel 32 is directly related to the amount of the topload applied by the pressure block 25. Stated otherwise, a channel 32 with a greater depth 39 requires more topload to form than a channel 32 with a decreased depth 39.

This discussion is of the prior art method and some portions may be used in the new method. For example, the capping apparatus 22 may not have a separate pressure block ejector 24 in the new method. Instead, the pressure block 25 would be a solid piece with a flat interior and contact surface 29 would not exist in at least one embodiment of the new method because the metallic closure 43 of embodiments of the current disclosure does not require a channel 32 to form a seal with the metallic bottle 40 of the current disclosure. Additionally, the force, e.g., the plug insertion force in the new method, on the metallic closure 43 would be placed along its top surface 44 in its entirety.

In FIG. 2, the capping apparatus 22 forms the closure threads 16 by pressing the at least two thread rollers 26 (only one shown) against predetermined portions of the closure body portion 12. The thread rollers 26 then wind axially around the bottle longitudinal axis 21 and down the body portion 12 along the bottle threads 8. The thread rollers 26 use the bottle threads 8 as a form for the closure threads 16. The closure threads 16 may be formed during one or more passes of the thread rollers 26. During each pass, the thread rollers 26 may make between about 1.75 to about 2 revolutions axially around the closure body portion 12.

In one or more embodiments, the capping apparatus 22 includes two thread rollers 26. Optionally, each of the two thread rollers 26 may be configured to apply less of a sideload force than other prior art thread rollers 26 illustrated in FIG. 1C. For example, in one embodiment, the two thread rollers 26 each apply less than about 30 pounds of force to the metallic bottle 2 and the ROPP closure 10. In another embodiment the thread rollers 26 each apply between about 15 pounds and about 35 pounds of force. In the prior art methods, to form the closure threads 16, the two thread rollers 26 may make at least two passes in contact with the body portion 12. In at least one embodiment, the two thread rollers 26 each make three passes to form the closure threads 16. In another embodiment, four passes by each of the two thread rollers 26 are used to form the closure threads 16.

Figure 6:
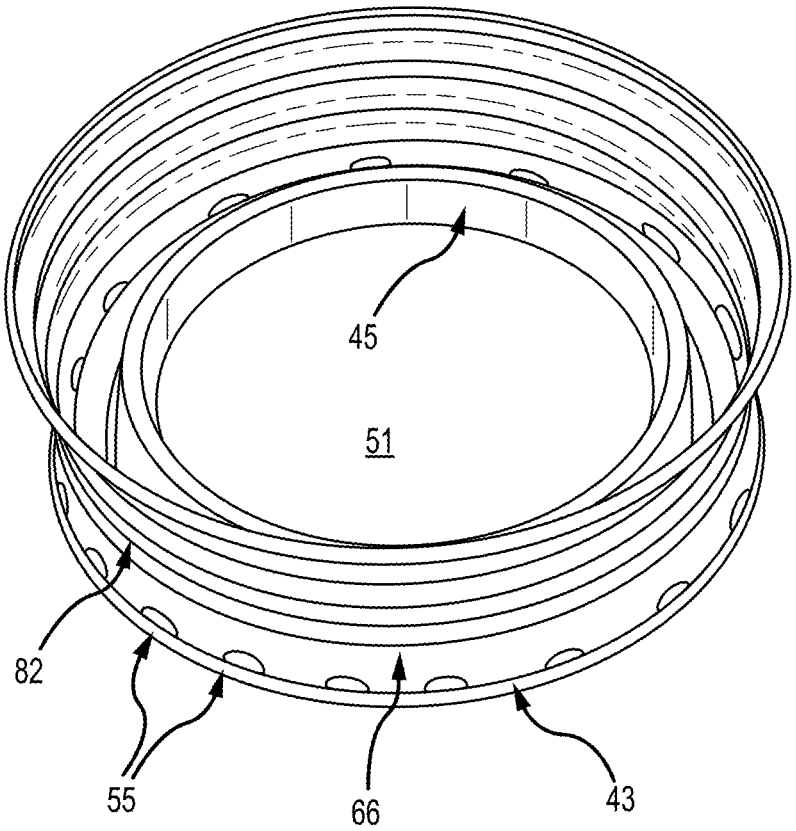
FIG. 6 is a perspective view of a metallic closure and a floating liner according to one or more embodiments of the disclosure.

In contrast, in embodiments of the new method disclosed herein, closure threads may be formed on the closure 43 by any means known to those of skill in the art. In some embodiments of the current disclosure, closure threads 82 (illustrated in FIG. 6) are formed on the closure 43 by only a single pass of one or two thread rollers using, for example, single pass cappers. Additionally, or alternatively, closure threads 82 may be pre-formed on the closure 43 before the closure 43 is positioned on a metallic container 40.

Optionally, the sideload force applied by the two thread rollers 26 may be different for one or more of the at least two passes. For example, in one embodiment, the two thread rollers 26 each apply a first predetermined sideload force on one of the passes and a second predetermined sideload force on a different pass. In one embodiment, a first thread roller 26 may optionally apply a different sideload force than a second thread roller 26.

Optionally, the prior art capping apparatus 22 includes three or more thread rollers 26. In an embodiment, each of the three or more thread rollers 26 may be configured to apply less sideload force than prior art thread rollers 26 illustrated in FIG. 1C. The three or more thread rollers 26 may make one or more passes to form the closure threads 16. In one embodiment in which the capping apparatus 22 includes four thread rollers 26, only one pass by each of the four thread rollers 26 is required to form the closure threads 16.

The pilfer rollers 28 apply a sideload force to the metallic bottle 2 to tuck the pilfer band 18 against the bottle skirt 30. In one embodiment, the pilfer rollers 28 tuck the pilfer band 18 against the bottle skirt 30 either before or after the thread rollers 26 form the closure threads 16. In this manner, the cumulative load applied to the metallic bottle 2 by the capping apparatus 22 is reduced compared to the cumulative load applied by the prior art capping apparatuses 22 in which the prior art thread rollers 26 and prior art pilfer rollers 28 apply sideloads simultaneously.

In one embodiment, the thread rollers 26 and the pilfer rollers 28 independently and consecutively form the closure threads 16 and tuck the pilfer band 18. In this embodiment the cumulative load applied to the metallic bottle 2 and the ROPP closure 10 is reduced without decreasing the individual sideloads applied by the thread and pilfer rollers 26, 28 from the current sideloads applied by prior art thread and pilfer rollers 26, 28 illustrated in FIG. 1C. Accordingly, the capping apparatus 22 may seal a prior art metallic bottle 2 with each thread roller 26 applying a sideload of less than about 30 pounds of force either before or after each pilfer roller 28 applies a sideload of less than about 35 pounds of force.

Similar to the thread rollers 26, the capping apparatus 22 may have two or more pilfer rollers 28. Each of the pilfer rollers 28 may be configured to apply less sideload force than prior art pilfer rollers 28 illustrated in FIG. 1C. For example, each pilfer roller 28 applies less than about 35 pounds of force to the metallic bottle 2 and the ROPP closure 10. The pilfer rollers 28 may tuck the pilfer band 18 against the bottle skirt 30 in any number of passes. In at least one embodiment in which the capping apparatus 22 includes three or more pilfer rollers 28, each pilfer roller 28 may make only one pass. In another embodiment, each pilfer roller 28 makes more passes but applies less sideload force than other prior art pilfer rollers 28 of capping apparatus 22. Optionally, at least one pilfer roller 28 of the two or more pilfer rollers applies a different sideload force than the other pilfer rollers 28. Additionally, the pilfer rollers 28 may optionally apply a different sideload force during different passes.

As one who is skilled in the art will appreciate, all metal forming operations involve some amount of spring back after a forming load is removed from a metallic workpiece. In metallic bottle sealing operations, after the topload applied by the pressure block ejector 24 and the pressure block 25 are removed, spring back of the metal of the metallic bottle 2 and or the ROPP closure 10 generally result in movement of the ROPP liner 14 axially along the longitudinal axis 21 and away from the bottle curl 6. In order to maintain the seal between the metallic bottle 2 and the ROPP closure 10, a predetermined amount of contact between the curl 6 and ROPP liner 14 must be maintained despite this spring back.

Figure 3:
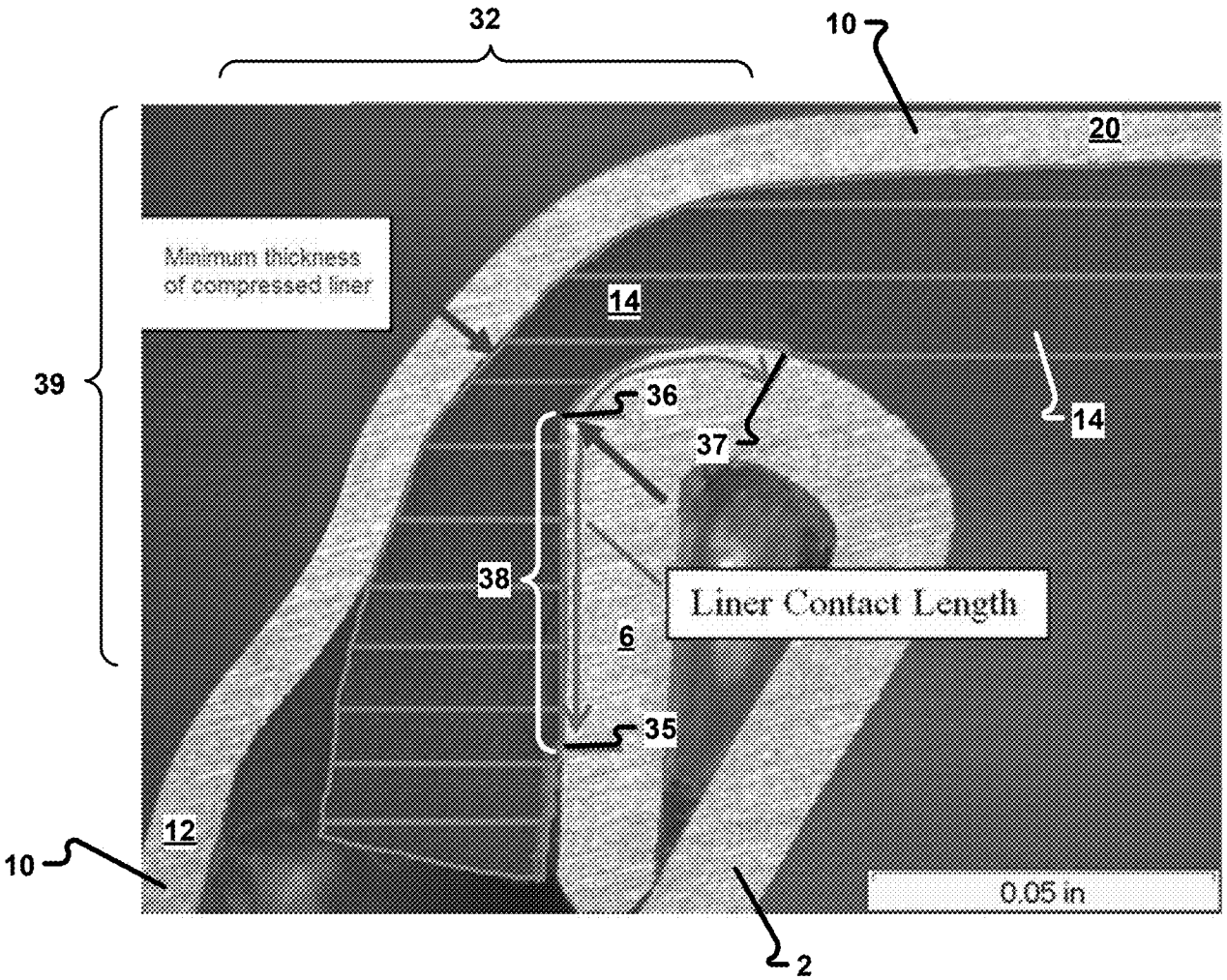
Fig. 3 (Prior Art)
FIG. 3 is a photograph of a cross section of a portion of a curl of a prior art metallic bottle in contact with a liner within a ROPP closure according to the prior art.

FIG. 3 shows an annotated photograph of a cross-section of portions of a prior art liner 14 between the closure channel 32 of the ROPP closure 10 and the bottle curl 6. The liner 14 has been outlined for clarity. The liner 14 contacts the curl 6 from approximately point 35 to approximately point 37. A region 38 of vertical contact extends from approximately point 35 to approximately point 36. To maintain the seal between the bottle curl 6 and the ROPP liner 14, the length of the vertical contact region 38 must be greater than a distance of axial travel of the ROPP closure 10 during spring back or greater than a distance the closure lifts upward relative to the metallic bottle 2 during a high pressure event (e.g., a carbonated beverage in a hot delivery truck in the summer). The length of the vertical contact region 38 may be increased by increasing the depth 39 of the closure channel 32. However, as described above, to increase the channel depth 39, the topload applied by the pressure block 25 to form the channel 32 must be increased.

To decrease the axial travel of the ROPP closure 10 during spring back, one or more of the metallic bottle 2 and the ROPP closure 10 may be rotated in a closing direction to drive the bottle curl 6 into the ROPP liner 14. Rotating either the metallic bottle 2 or the ROPP closure in the closing direction during the sealing of the metallic bottle 2 generally improves the seal between the closure liner 14 and the bottle curl 6 when this type of prior art liner is used.

It will be appreciated by one of skill in the art that the curl 6 may be driven further into the liner 14 by rotating either the ROPP closure 10 or the metallic bottle 2. Accordingly, the metallic bottle 2 can be rotated axially in the closing direction instead of, or in addition to, each rotation of the ROPP closure 10 in the closing direction. For example, the capping apparatus 22 (FIG. 2) further comprises a tool to hold the metallic bottle 2 during sealing by the capping apparatus 22. The tool may be one or more of a chuck 33 and a holder 34.

Each rotation of the ROPP closure 10 and/or the metallic bottle 2 may be less than a complete revolution around the longitudinal axis 21. Accordingly, one or more of the metallic bottle 2 and the ROPP closure 10 can be rotated at least a portion of one revolution around the longitudinal axis 21 in the closing direction.

Figure 4:
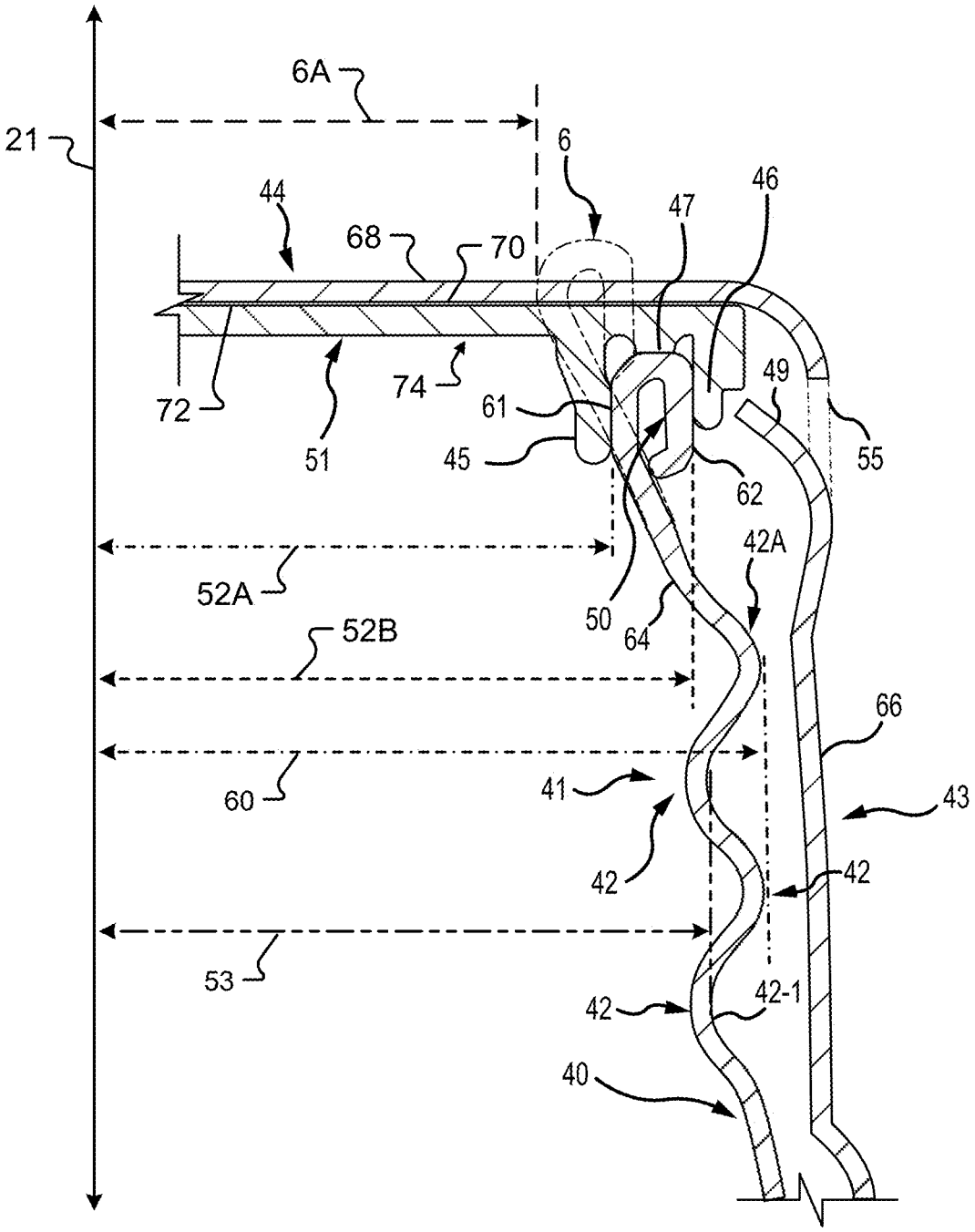
FIG. 4 shows a cross-sectional elevation view of a portion of a container comprising a metallic bottle and a metallic closure, and illustrating a floating liner with a plug seal according to embodiments of the present disclosure, the metallic closure shown before threads are formed, and further illustrating a bottle curl of the prior art in phantom lines for reference.

FIG. 4 shows a vertical cross-sectional view (parallel to a longitudinal axis 21) of a portion of a container comprising a metallic bottle 40 and a closure 43 according to embodiments of the present disclosure.

Although only the upper portion and neck 41 of the metallic bottle 40 are illustrated, the metallic bottle 40 generally includes a closed end portion, a body portion extending upwardly from the closed end portion, a neck portion 41 with bottle threads 42 and a skirt 30, and an opening opposite to the closed bottom portion. The closed end portion, body portion, bottle threads 42, and skirt of metallic bottle 40 are the same as (or similar to) the body portion 3, closed end portion 4, bottle threads 8 and skirt 30 of the prior art metallic bottle 2 described herein.

The metallic bottle 40 may include any number of bottle threads 42 that each have a predetermined size, shape, and pitch. In at least one embodiment of the present disclosure, the bottle threads 42 have a pitch of between about 0.10 inches and about 0.15 inches. In other embodiments, the bottle threads 42 have an exterior (or outer) diameter 60 of between approximately 1.0 inches and approximately 1.6 inches.

The bottle threads 42 may be integrally formed on the neck portion 41. Alternatively, the bottle threads 42 may be formed on an outsert that is interconnected to the neck portion 41 as described in U.S. Patent Application Publication No. 2014/0263150 which is incorporated herein in its entirety. Other methods and apparatus used to form threads on metallic containers are described in U.S. Patent Application Publication No. 2012/0269602, U.S. Patent Application Publication No. 2010/0065528, U.S. Patent Application Publication No. 2010/0326946, U.S. Pat. Nos. 8,132,439, 8,091,402, 8,037,734, 8,037,728, 7,798,357, 7,555,927, 7,824,750, 7,171,840, 7,147,123, 6,959,830, and International Application No. PCT/JP2010/072688 (publication number WO/2011/078057), which are all incorporated herein in their entirety by reference.

The body portion of the metallic bottle 40 may have any desired size or shape. For example, in one embodiment, the body portion has a generally cylindrical shape. The body portion may include a waist portion with a reduced diameter. In one embodiment, the waist portion includes an inwardly tapered cross-sectional profile. The closed end portion (i.e., bottom portion) may include an inward dome.

Figure 1D:
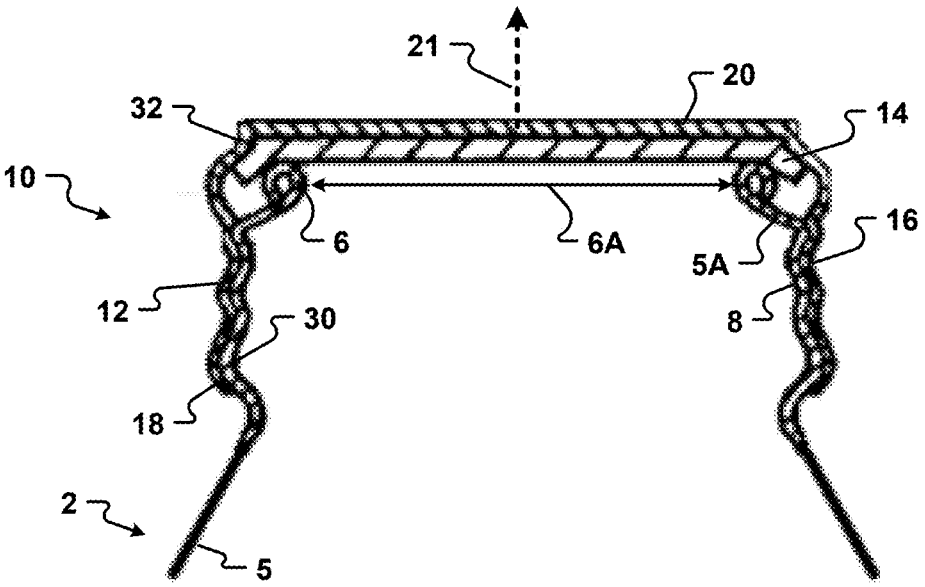
Fig. 1D (Prior Art)
FIG. 1D illustrates the metallic bottle of FIG. 1A after it is sealed with a ROPP closure.

The metallic bottle 40 of the current disclosure has a curl 50 that is significantly different than the prior art curl 6. For comparison, the metallic bottle 40 is also shown in FIG. 4 with a prior art curl 6 of the metallic bottles 2 described in conjunction with FIGS. 1D, 2 and 3 shown in phantom lines. Notably, the curl 50 of the new metallic bottle 40 has an inner curl surface 61 with a diameter 52A (measured perpendicular to the longitudinal axis 21 of the metallic bottle) that is significantly greater than the diameter 6A of the inner surface of the prior art curl 6. This is true when both the prior art metallic bottle 2 and the new metallic bottle 40 have a thread root diameter 53 measured from the thread root 42-1 of the bottle threads 42, 8 that are equal. As will be appreciated by one of skill in the art, the thread root diameter 53 may also be described as the minor diameter of the bottle threads 42, 8 measured across the root 42-1 of the threads. Moreover, the thread root diameter 53 is measured from an exterior surface of a thread root 42-1 on a first side of the metallic bottle 40 to an exterior surface of another thread root 42-1 on a second side of the metallic bottle opposite to the first side.

The prior art metallic bottle 2 requires its curl 6 to have inner curl diameter 6A that is substantially less than the thread root diameter 53 to permit the prior art liner material 14 to extend beyond a seal surface on the outer diameter of the curl 6 so that the liner material 14 can then be reformed downward along the curl outer diameter surface (i.e., along the vertical contact region 38 illustrated in FIG. 3). More specifically, the prior art liner 14 must have a diameter that extends beyond the outer surface of the curl 6 to accommodate the required downward bending (by the channel 32) to form an adequate seal. However the diameter of the liner 14 is constrained at a maximum by the interior diameter of the closure body 12 and tools inserted into the closure body to form the liner 14 proximate to the top 20 of the closure body. Given the maximum diameter limit of the liner 14, the curl 6 must be sufficiently inboard of the closure body. The diameter of the liner 14 is further constrained by the exterior diameter of the closure threads 16 (known as the "thread peak") because the thread peak drives the diameter of the closure shell 9, which limits the maximum diameter of the liner 14. The thread peak defines the diameter of the thread root because the closure threads 16 must have a minimum thread depth to avoid blowoff of the closure 10 from the bottle threads 8 due to pressure within a sealed container. Accordingly, because prior art liner 14 must be pressed down around an outer surface of the prior art curl 6 of the prior art metallic bottle, the prior art curl 6 must be set inwardly further from the thread root 42-1 to permit the prior art liner 14 of the prior art ROPP closure 10 to form an adequate seal with the curl, specifically over the top or around an outer surface of the curl and not along the inner surface of the curl. The prior art curl 6 simply cannot be positioned outwardly closer to the thread root diameter 53 because the closure body 12 would prevent the required downward bending of the liner 14 by the channel 32 necessary for the liner 14 to contact the curl 6 in the vertical contact region 38.

In addition, the prior art curl 6 extends upward further above the uppermost portion 42A of the bottle threads 42 than the curl 50 of the current disclosure. Accordingly, the inwardly tapered (or conical portion 64) between the uppermost portion 42A of the bottle threads and the beginning of the curl 50 is shortened for the current curl 50, and longer in the prior art curl 6.

The shorter conic portion 64 of the new metallic bottle 40 is beneficial because fewer necking stages (or operations) are required to produce the conic portion 64 and less metal material is required to form the metallic bottle 40 compared to a prior art metallic bottle 2 with a body portion of the same diameter and adapted to store a similar volume of product. In contrast, the conic portion 5A of the prior art metallic bottle 2 (illustrated in FIG. 1D) requires more necking operations and requires more metal material than the new metallic bottle 40. Accordingly, the new metallic bottle 40 is less expensive to produce and requires less metal material compared to the prior art metallic bottle of the same diameter and volume.

Another benefit of forming the new curl 50 on a shorter conic portion 64 such that it has a larger inner diameter 52A compared to the prior art curl 6 is that the operation required to form the prior art curl 6 on a prior art metallic bottle 2 creates a load spike during the manufacturing process. The load spike can damage the metallic bottles, causing them to fail quality inspections resulting in waste.

Figure 5A:
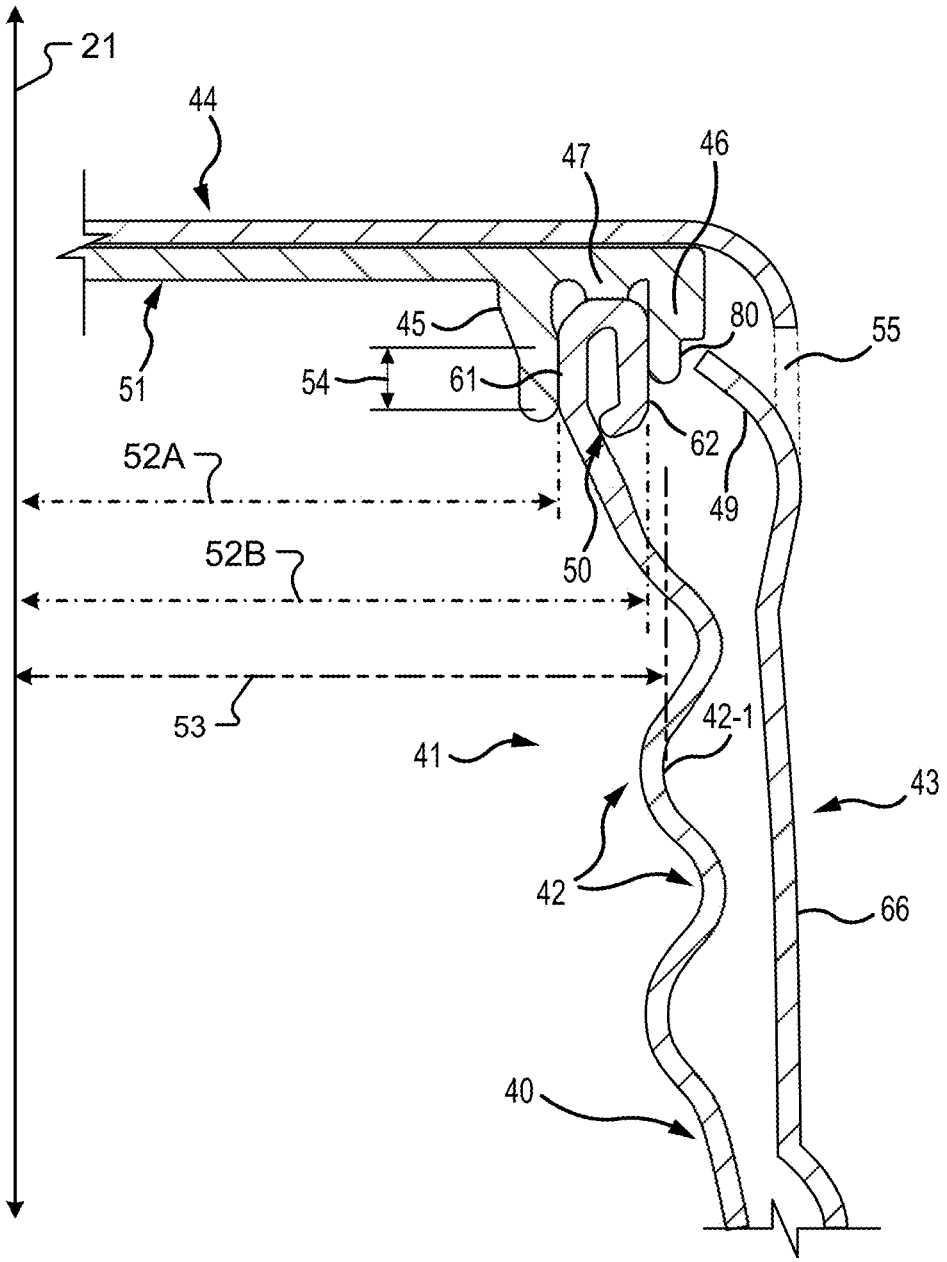
FIG. 5A is another cross-sectional elevation view of a portion of a container similar to FIG. 4, but the prior art bottle curl is not shown and additional dimensions are shown.
Figure 5C:
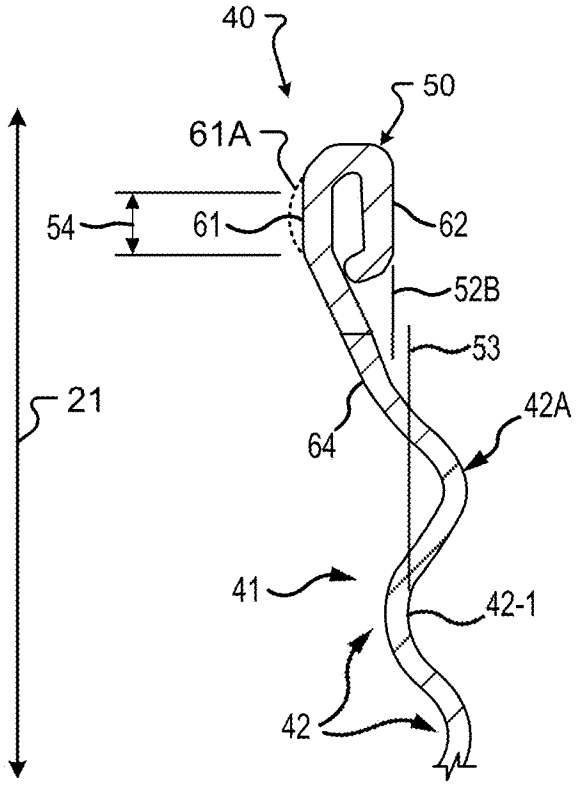
FIG. 5C is a cross-sectional elevation view of a portion of the metallic bottle of FIG. 5A.

Another benefit of the new curl 50 is that the new, shortened conic portion 64 is less overhung (cantilevered) compared to the prior art curl 6. Accordingly, the new conic portion 64 is oriented more vertically relative to the longitudinal axis 21 (as generally illustrated in FIG. 5C). Accordingly, a large vertical load applied to the curl 50 (such as when the curl is formed) can be transferred by the conic portion 64 to stronger portions of the metallic bottle below the conic portion without damage to the bottle.

In contrast, the prior art curl 6 has a smaller diameter with a longer conic portion 5A (such as illustrated in FIG. 1D). A conic portion 5A which is more overhung (for example, when the conic portion 5A is oriented closer to 90 degrees relative to the longitudinal axis 21) is weaker and less able to transfer vertical load applied to the curl 6 to the supporting bottle geometry below. Accordingly, the conic portion 5A on the prior art metallic bottle 2 is more likely to fail during curling, than the new curl 50 with a larger diameter and shorter conic 64.

In at least some embodiments, at least a portion of the inner diameter surface 61 of the container curl 50 is substantially flat in cross-section (or substantially parallel to the longitudinal axis 21 of the metallic bottle 40).

Alternatively, as generally illustrated in FIG. 5C, in other embodiments, the inner diameter surface 61A of the curl 50 may be arcuate or rounded when viewed in a vertical cross section of the metallic bottle 40.

The closure 43 is generally illustrated in FIG. 4 and has a top portion 44. An outer perimeter wall or body portion 66 extends downwardly from the top portion. In at least some embodiments a bend is positioned between the top portion 44 and the body portion 66.

The body portion 66 has a generally cylindrical shape and is illustrated in FIG. 4 before closure threads are formed on it. When the closure 43 is sealed to the metallic bottle 40, closure threads of any type known to those of skill in the art may be formed on the closure 43 in any manner. The closure threads may be of any predetermined size, shape, and pitch. In some embodiments, one thread roller 26 (or two thread rollers 26) may be used to form closure threads 82 (illustrated in FIG. 6) on the closure 43.

In some embodiments, the closure 43 is a screw-on closure. Alternatively, the closure 43 is a roll on pilfer proof closure.

In still other embodiments, the closure 43 is a twist on closure. Optionally, the twist on closure comprises lug threads or partial threads of any type known to those of skill in the art.

The top portion 44 includes an upper surface 68 and a lower surface 70. In some embodiments, one or more of the upper surface 68 and the lower surface 70 is substantially planar or flat.

The closure 43 can also optionally include fluid flow-through features, such as vents 55 to allow ingress and egress of fluids (such as air to offset pressure) to and from metallic bottle 40. The vents 55 may be formed by cutting or punching an aperture through the closure body 66. In some embodiments, the vents 55 are formed by cutting a portion of the closure body 66, while leaving the cut material attached to the closure body. The cut material may then optionally be bent inwardly (toward the longitudinal axis 21). In this manner, the bent material can form a retaining element 49 according to embodiments of the present disclosure. A plurality of retaining elements 49 formed in this manner around the circumference of the closure body 66 beneficially work together to retain the floating liner 51 in the closure 43.

The closure 43 may include only retaining elements 49 associated with corresponding vents 55. Alternatively, the closure 43 may include retaining elements 49 that are separate from the vents 55.

In other embodiments, retaining elements are formed without puncturing and/or cutting the closure body 66. For example, the closure 43 may include a plurality of protrusions around the circumference of the closure body 66, with the protrusions extending inwardly (toward the longitudinal axis 21) to decrease the interior diameter of the closure body. The protrusions define retaining elements 49 which are separate from the vents 55.

The closure 43 has a floating liner 51 according to embodiments of the present disclosure. The floating liner 51 comprises a top surface 72 adapted to be positioned proximate to the lower surface 70 of the closure 43 when the floating liner 51 is positioned in the closure 43. In at least some embodiments, the top surface 72 is substantially planar or flat.

Notably, the floating liner 51 of the present disclosure is not attached to the closure 43 and, thus, it can "float" or move laterally (or radially perpendicular to the longitudinal axis 21 of the metallic bottle 40) relative to the lower surface 70 of the closure 43.

In one or more embodiments of the disclosure, the top surface 72 of the floating liner 51 is not attached, fixed, glued or interconnected to the lower surface 70 of the closure 43.

The floating liner 51 further comprises engagement elements that extend away from the top surface 72 of the floating liner 51. The engagement elements are configured to contact one or more surfaces of the curl 50 when the closure 43 is positioned to seal the metallic bottle 40. The engagement elements may comprise one or more of an inner plug seal 45 (also called a "plug seal" herein), an outer alignment support 46, and an upper bumper 47 disposed therebetween.

In at least one embodiment, the floating liner 51 has only the inner plug seal 45.

In other embodiments, the floating liner 51 has both the inner plug seal 45 and the outer alignment support 46, but does not include the upper bumper.

In some embodiments, the floating liner 51 includes each of the inner plug seal 45, the upper bumper 47, and the outer alignment support 46.

In still other embodiments, the floating liner 51 includes at least one engagement element that is structurally capable of achieving the same function as at least one aforementioned example of an engagement element.

A circular portion 74 of the floating liner 51 is positioned radially inward of the inner plug seal 45. The inner plug seal 45 is positioned between the circular portion 74 and the optional upper bumper 47 and/or the optional outer alignment support 46 when present. Accordingly, the optional upper bumper 47 may be described as being positioned between the inner plug seal 45 and outer alignment support 46.

The inner plug seal 45 extends downward from the liner 51 (i.e., toward the closed bottom end portion of the metallic bottle 40) a distance sufficient to contact the inner diameter surface 61 of the curl 50. Contact between an outer surface 86 of the inner plug seal 45 (best seen in FIG. 5B) and the inner diameter surface 61 forms a seal between the closure 43 and the metallic bottle 40.

The floating liner 51 and its inner plug seal 45 provide many benefits and advantages over the prior art liner 14. One advantage of the inner plug seal 45 is that it engages the inner diameter surface 61 of the curl 50. In contrast, as described above and in conjunction with FIG. 3, the prior art liner 14 must engage the exterior diameter of the prior art curl 6. This requires the ROPP closure 10 to be reformed with a channel 32 which requires a significant top load from the capping apparatus 22. Further, to provide space for the liner 14 between the exterior diameter of the prior art curl 6 and the interior surface of the closure body 12, the prior art curl 6 must be spaced inwardly from the thread root diameter 53 (and from the closure body 12) further than the new curl 50. As described above, one or more extra necking operations are required to form prior art conic 5A to reduce the inner curl diameter 6A of the prior art curl 6.

The purpose of the outer alignment support 46 portion of the floating liner 51 is to help align the floating liner 51 in the proper position on the container curl 50. Specifically, when present, the outer alignment support helps position the inner plug seal 45 correctly on the inner diameter surface 61 of the curl 50 to form a seal.

In some embodiments, the outer alignment support 46 portion of the floating liner 51 is thicker than the inner plug seal 45. More specifically, in at least one embodiment, the inner plug seal 45 has a first maximum thickness measured in a radial direction parallel to the top surface 72 of the floating liner 51 (or measured perpendicular to the longitudinal axis 21 of the metallic bottle). The outer alignment support 46 has a second maximum thickness measured in the radial direction. In at least some embodiments, the second maximum thickness is greater than the first maximum thickness. Forming the outer alignment support 46 with a second maximum thickness greater than the first maximum thickness is beneficial because the outer alignment support 46 can be retained and held in the closure 43 by retaining elements 49 associated with the vent features 55 as discussed with FIG. 4 and as shown in FIGS. 4 and 5A.

Figure 5B:
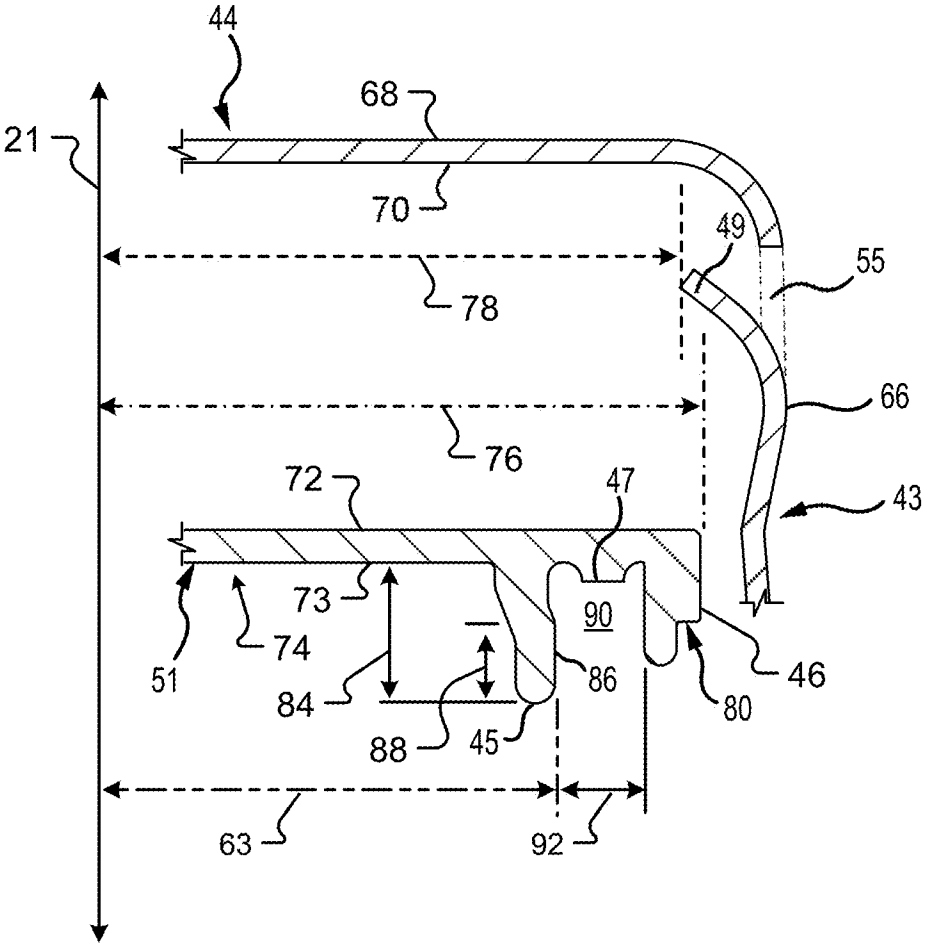
FIG. 5B is an exploded cross-sectional elevation view of portions of the metallic closure and the floating liner of FIG. 5A.

In some embodiments, the outer alignment support 46 optionally comprises a notch 80 on its outer diameter surface (as generally illustrated in FIG. 5B). When present, the notch 80 provides a surface for engagement by retention elements 49 of the closure to selectively engage. In at least one embodiment, the notch 80 is spaced from the top surface 72 of the liner 51 and extends to a free end of the outer alignment support 46. Accordingly, in at least one embodiment, the presence of the notch 80 means that the free end of the outer alignment support 46 has a thickness that is less than the second maximum thickness measured through a portion of the outer alignment support 46 that does not include the notch.

The outer alignment support 46 is not required and embodiments of the present disclosure include a floating liner 51 with an inner plug seal 45 and no outer alignment support 46. In embodiments with and without the outer alignment support 46, the floating liner 51 may self-align to the container bore (the inner diameter surface 61 of the curl 50) solely via the outer surface 86 of the inner plug seal 45 engaging the inner diameter surface 61.

In some embodiments, between the outer alignment support 46 and the inner plug seal 45 is an upper bumper 47. The upper bumper 47 is configured to contact a top portion of the curl 50. The upper bumper 47 may assist with sealing the closure 43 on the metallic bottle 40. Moreover, the upper bumper 47 may protect the closure 43 from damage if the container receives an impact or other force on the closure, for example, if the metallic bottle 40 is dropped and the closure 43 hits the ground or if something is dropped on top of the closed metallic bottle 40 when in transit.

Additional embodiments are contemplated wherein additional or combination engagement elements may be utilized, such as an upper bumper that resembles a U-shape capable of engaging around the container curl 50 in lieu of one, or more, aforementioned engagement elements.

FIGS. 5A, 5B and 5C provide additional views of the metallic bottle 40, the closure 43, and the floating liner 51. FIG. 5A is similar to FIG. 4, but the prior art bottle curl 6 is not shown and additional dimensions are shown. For example, the outer diameter 52B of the curl 50 (measured at the curl outer surface 62) of the present metallic bottle 40 is only slightly smaller than the outer thread root diameter 53 of the metallic bottle 40 measured at the thread root 42-1.

In some embodiments, the outer diameter 52B of the curl 50 is between about 1.0 inch and 1.6 inch. In other embodiments, the outer diameter 52B of the curl 50 is between about 1.25 inch and 1.45 inch.

In some embodiments, the outer diameter 52B of the curl 50 is about 1.35 inch with a tolerance of +/−0.008 inch.

There are manufacturing tolerances for bottle threads 42 and curl 50 concentricity. Therefore, the curl 50 will be undersized from the thread root diameter 53 such that the tolerance stack up does not allow the thread root of closure threads formed on the closure 43 (not shown in FIG. 5A) to interfere with the bottle curl 50. More specifically, because closure threads 82 (shown in FIG. 6) are formed on the closure 43 by pressing the body portion 66 inwardly against the bottle threads 42, if the outer surface 62 of the curl 50 has an outer diameter 52B that is too close to the diameter 53 of thread root 42-1, when the body portion 66 is pressed against the thread root 42-1, an interior diameter of the closure thread 82 may be less than the outer diameter 52B of the curl but still comply with manufacturing tolerances. But if the inner diameter of the closure thread 82 is less than the curl outer diameter 52B, the closure 43 will be difficult (or impossible) to remove from the metallic bottle 40. However, as described previously, due to the floating liner 51 and its plug seal 45, the outer curl diameter 52B can be a larger percentage of the thread root diameter 53 than in the prior art metallic bottles 2.

In some embodiments, the outer curl diameter 52B is between about 1.2 inches and 1.4 inches. In other embodiments, the outer curl diameter 52B is between about 1.3 inches and 1.38 inches. In at least one embodiment, the outer curl diameter 52B is about 1.351 inches.

In some embodiments, the thread root diameter 53 is between about 1.25 inches and 1.45 inches. In other embodiments, the thread root diameter 53 is between about 1.35 inches and 1.39 inches. In at least one embodiment, the thread root diameter 53 is about 1.377 inches.

In some embodiments, the difference between the outer curl diameter 52B and the thread root diameter 53 is less than about 0.035 inches. In other embodiments, the difference between the outer curl diameter 52B and the thread root diameter 53 is less than about 0.031 inches. In at least one embodiment, the difference between the outer curl diameter 52B and the thread root diameter 53 is less than about 0.029 inches. In one or more embodiment, the difference between the outer curl diameter 52B and the thread root diameter 53 is about 0.026 inches.

In some embodiments, the outer curl diameter 52B is at least about 90% of the thread root diameter 53.

In other embodiments, the outer curl diameter 52B is at least about 95% of the thread root diameter 53.

In one or more embodiment, the outer curl diameter 52B is at least about 97% of the thread root diameter 53.

In other embodiments, the outer curl diameter 52B is about 98% of the thread root diameter 53.

In some embodiments, the inner surface 61 of the curl 50 has a diameter 52A of between about 0.9 inch and 1.5 inch. In other embodiments, the diameter 52A of the curl inner surface 61 is between about 1.15 inch and 1.35 inch. In at least one embodiment, the diameter 52A is about 1.245 inch with a tolerance of +/−0.002 inch.

Referring now to FIG. 5B, an outer diameter 76 of the floating liner 51 is illustrated relative to an inner diameter 78 defined between opposing retaining elements 49. As shown, in at least one embodiment, the outer diameter 76 is greater than the inner diameter 78 defined by the retaining elements 49. Accordingly, when the top surface 72 of the liner 51 is positioned proximate to the lower surface 70 of the closure 43 (such as generally illustrated in FIG. 5A), the liner 51 is retained proximate to the lower surface 70 by the retaining elements 49.

The retaining elements 49 are configured to prevent unintended or inadvertent movement of the floating liner 51 away from the lower surface 70 of the closure (such as by moving toward the closed end of the metallic container 40). However, the retaining elements 49 permit the floating liner 51 to move laterally (or approximately perpendicular to the longitudinal axis 21) relative to the lower surface 70 of the closure 43.

In some embodiments, the plug seal 45 has a length 84 of between about 0.1 inch and 0.35 inch measured from a bottom surface 73 of the floating liner. In other embodiments, the length 84 is between about 0.15 inch and 0.27 inch. In at least one embodiment, the length 84 of the plug seal 45 is between about 0.17 inch and 0.23 inch. In still other embodiments, the length 84 is about 0.177 inch. In one or more embodiments, the length 84 is about 0.22 inch.

In some embodiments, the outer surface 86 of the inner plug seal 45 has an outer diameter 63. In some embodiments, the outer surface 86 is substantially constant from its root (proximate to the bottom surface 73) to its free or distal end.

In other embodiments, the outer surface 86 of the inner plug seal 45 changes from root to tip. For example, in some embodiments, the maximum outer diameter 63 of the inner plug seal 45 is spaced from the bottom surface. In this manner, the maximum outer diameter 63 of the inner plug seal 45 is toward the bottom of the inner surface 61, 61A of the curl 50. Forming the maximum outer diameter 63 of the plug seal to align with the inner diameter surface 61 is beneficial to allow for lifting (i.e., doming) of the closure top 44 upward due to internal pressure while continuing to ride up the inner diameter surface 61 of the bottle curl 50 as described herein in conjunction with FIGS. 7A, 7B.

In some embodiments, the outer diameter 63 of the inner plug seal 45 is between about 0.9 inch and 1.5 inch. In other embodiments, the outer diameter 63 is between about 1.15 inch and 1.35 inch. In at least one embodiment, the outer diameter 63 is about 1.245 inch with a tolerance of +/−0.002 inch.

In one or more embodiment, the outer surface 86 of the inner plug seal 45 is linear when viewed in cross section (such as generally illustrated in FIG. 5B). Optionally, at least a portion of the outer surface 86 is linear in cross-section. In at least some embodiments, the linear portion of the outer surface 86 is approximately parallel to the longitudinal axis 21.

In some embodiments, a length 88 of the straight (or linear) portion of the outer surface 86 of the inner plug seal 45 is between about 0.02 inch and 0.06 inch. Alternatively, in other embodiments, the length 88 is between about 0.02 inch and 0.2 inch. In some embodiments, the length 88 is between about 0.09 inch and 0.19 inch. In still other embodiments, the length 88 is between about 0.14 inch and about 0.18 inch. In at least one embodiment, the length 88 is approximately 0.16 inch.

When present, the optional outer alignment support 46 is spaced from the outer surface 86 of the inner plug seal 45 to define a receiving space 90 to receive the curl 50. The curl receiving space 90 has a width 92 measured perpendicular to the longitudinal axis 21. In some embodiments, the width 92 is between about 0.3 inches and about 0.09 inches. In other embodiments, the width 92 is between about 0.05 inches and about 0.07 inches. In still other embodiments, the width 92 is about 0.057 inches.

Referring now to FIG. 5C, the curl 50 has an inner diameter surface 61, 61A. The inner diameter surface 61, 61A of the curl 50 must be long enough to allow sufficient sealing between the inner diameter surface 61, 61A and the inner plug seal 45.

In at least some embodiments, the curl 50 has a straight or flat portion on one or both of the inner diameter surface 61 and the outer diameter surface 62. More specifically, in at least one embodiment, at least a portion of an inner surface 61 of the curl 50 is linear (or straight) in a vertical cross-section of the curl 50. The linear inner surface 61 is optionally oriented substantially parallel to the longitudinal axis 21. In some embodiments, the straight portion of the linear inner surface 61 extends from a vertical tangent of the curl top radius to a vertical tangent at the bottom of the straight portion.

Alternatively, in other embodiments, the curl inner surface 61A is arcuate or curved.

In some embodiments, a length 54 of the straight portion of the inner diameter surface 61 is between about 0.02 inch and 0.06 inch. Alternatively, in other embodiments, the length 54 of the straight portion of the inner diameter surface 61 is between about 0.02 inch and 0.2 inch. In some embodiments, the length 54 is between about 0.09 inch and 0.19 inch. In still other embodiments, the length 54 is between about 0.14 inch and about 0.18 inch. In at least one embodiment, the length 54 is approximately 0.16 inch.

In some embodiments, the length of the curved surface of the inner diameter surface 61A is between 0.02 inch and 0.2 inch.

Additionally, or alternatively, in at least one embodiment, at least a portion of an outer surface 62 of the curl 50 is linear (or straight) in a vertical cross-section of the curl 50. Optionally, the linear outer surface 62 is optionally oriented substantially parallel to the longitudinal axis 21.

Figures 7A, 7B:
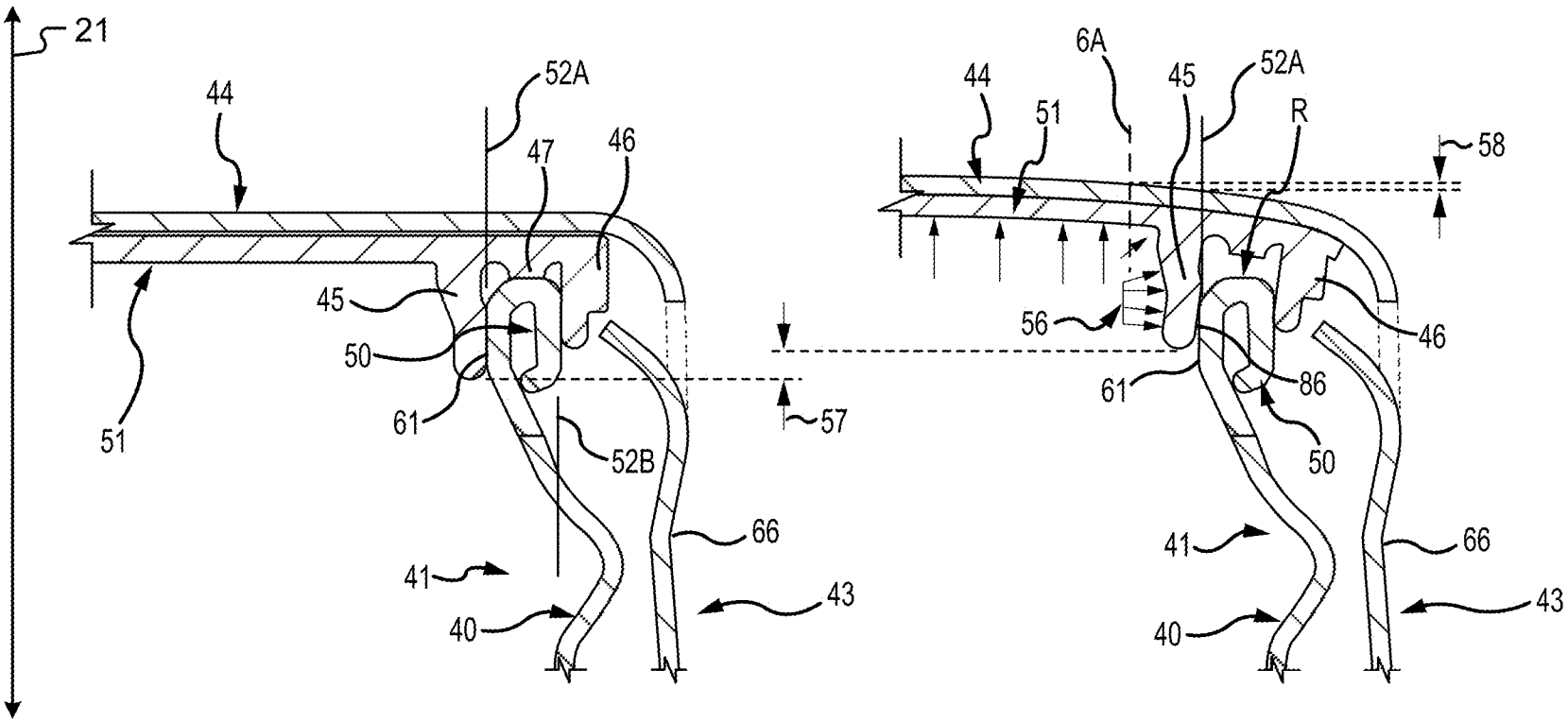
FIG. 7A is a cross-sectional elevation view of a portion of a container comprising a metallic bottle and a metallic closure with a floating liner according to embodiments of the present disclosure and illustrates the container before it is pressurized.
FIG. 7B illustrates the portion of the container of FIG. 7A after it is pressurized.

FIG. 7A shows the container (neck 41 of the metallic bottle 40 and closure 43) before it is pressurized and FIG. 7B shows the container after it is pressurized. After the container is pressurized, the pressure from the beverage gas pushes the floating liner 51 up toward the closure top 44 and the pressure from the beverage gas pushes (indicated by force arrows 56) the outer surface 86 of the inner plug seal 45 against the inner diameter surface 61 of the curl 50, which causes an even greater seal between the closure 43 and the metallic bottle 40 than a simple interference fit can provide. The force arrows 56 show the pressure of the inner plug seal 45 against the inner diameter surface 61 of the bottle curl 50, which reinforces the seal between the inner plug seal 45 and the inner diameter surface 61.

The internal container pressure from the beverage will also cause the closure top 44 to move or dome upward. The outer surface 86 of the inner plug seal 45 can move upward with the closure top 44 and floating liner 51 without losing contact with the inner surface 61 of the curl 50. In this manner, the seal between the inner surface 61 of the curl 50 and the outer surface 86 of the inner plug seal 45 is maintained even when the closure top 44 domes upwardly under pressure. For example, the inner plug seal 45 may move up a distance 57, as shown in FIGS. 7A and 7B, but will remain in contact with the inner surface 61 of the curl 50 due to the length of the inner surface 61 and due to the height 84 of the inner plug seal 45.

The shape and location of the curl 50 of the new metallic bottle 40 further assists with reducing the vertical movement of the inner plug seal 45 on the inner surface 61 of the bottle curl 50 and results in less seal venting. Specifically, the curl 50 of the present disclosure has a larger outer diameter 52B than the outer diameter of the prior art bottle curl 6 (in FIG. 4). This means the inner diameter surface 61 of the curl 50 is also closer to the outer diameter of the body portion 66 of the closure 43 (or closure to the exterior surface of the cylindrical body of the closure) and also places the inner plug seal 45 closer to the outer diameter of the closure 43. When the metallic bottle 40 is under pressure and the closure 43 domes upward, the inner plug seal 45 will move upward less the closer the inner plug seal is to the outer diameter of the closure 43. This is beneficial because the less the inner plug seal 45 moves upward (when dimension 57 is minimized), the less likely seal venting will occur (i.e., when the inner plug seal 45 separates from the inner surface 61 of the curl 50).

Distance 58 in FIG. 7B generally illustrates the additional amount of vertical (upward) movement that would detrimentally occur if the inner surface 61 of the curl 50 was moved inward (to the left in the perspective of FIG. 7A) from its current position to the position of the inner surface (indicated by line 6A) of the prior art curl 6. Specifically, if the inner diameter 52A of the inner surface 61 of the curl 50 was decreased to the inner diameter 6A of the prior art curl 6, more doming and vertical movement could occur. As the inner surface 61 of the curl 50 is moved inwardly (away from the body portion 66 of the closure 43 and toward the longitudinal axis 21) doming increases and the distance 58 increases. In contrast, as the inner surface 61 of the curl 50 is moved away from the axis 21 toward the body portion 66, less doming occurs. Accordingly, the inner surface 61 of the curl 50 and the inner curl diameter 52A provide benefits (such as increased ability to maintain a seal under pressure) compared to the prior art curl 6 and its inner curl diameter 6A.

Figure 8A:
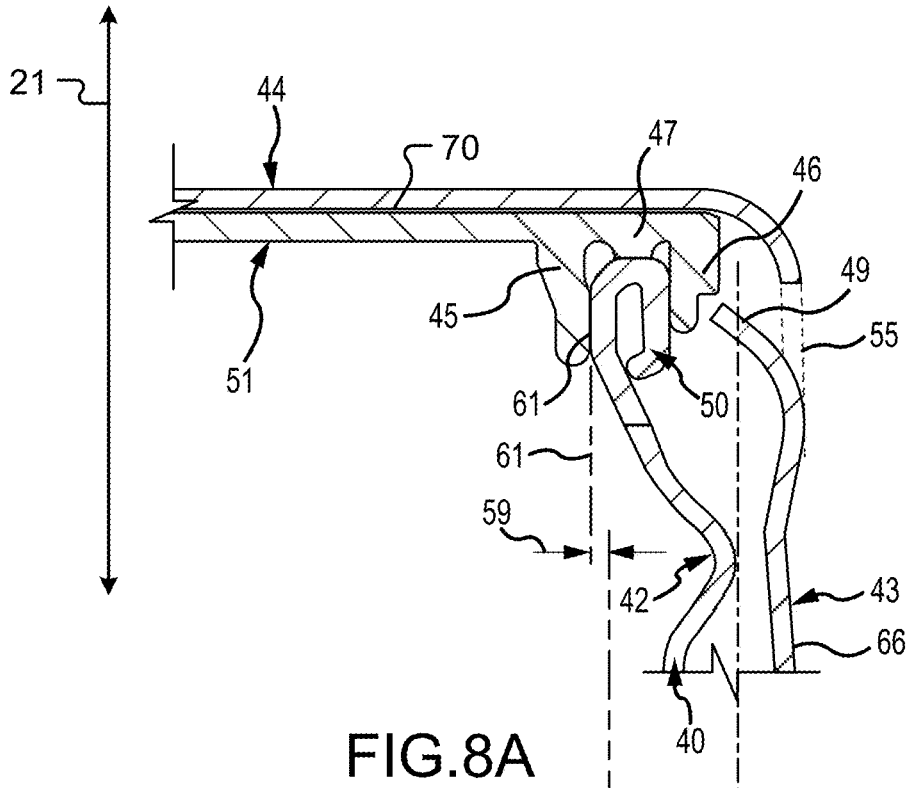
FIG. 8A is a cross-sectional elevation view of a portion of a container comprising a metallic bottle and a metallic closure with a floating liner according to embodiments of the present disclosure and illustrates the bottle curl concentrically aligned with bottle threads of the metallic bottle.
Figure 8B:
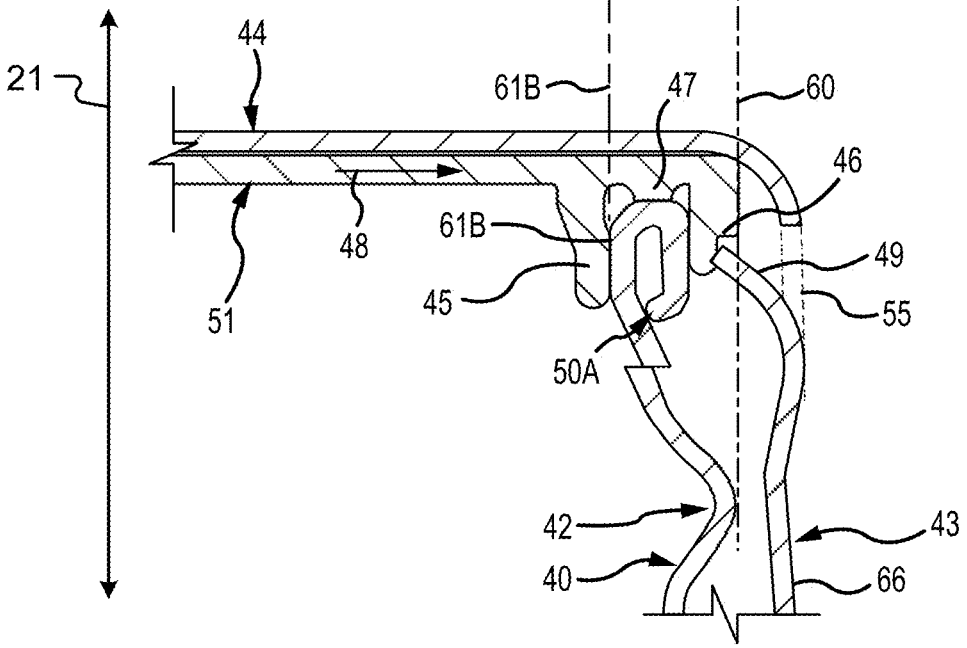
FIG. 8B is another cross-sectional elevation view of a portion of a container comprising a metallic bottle and a metallic closure with a floating liner according to embodiments of the present disclosure and illustrates the bottle curl not concentrically aligned with the bottle threads of the metallic bottle.

Regarding FIGS. 8A and 8B, metal forming of concentric features (e.g., concentric bottle openings and concentric metal closures) is difficult. Each necking stage to reduce the diameter of the opening of the metallic bottle 40 relies on a previously formed guide surface that has a clearance or tolerance. In the best case scenario, the concentric features will only deviate from perfect concentricity by the clearance of the guide surface. However, operations like threading or curling completely eliminate the guide surface that once existed and these operations create a new geometry that is neither perfectly round nor perfectly concentric. The problem is exacerbated with a metallic bottle 40 and a metallic ROPP closure 43 that establishes a concentricity datum from the bottle threads formed by low precision tools of a capping apparatus 22. This is a problem for metallic containers, but it is not a problem for glass or plastic containers. PET plastic bottles do not have the same magnitude of non-concentricity issues because all features (e.g., the bottle bore and threads) are molded simultaneously.

For a plug seal that is fixed to a closure (such as used to close a PET bottle) to work properly, the closure threads and the inner diameter of the bottle opening should be concentric. As mentioned, this is generally not a problem for glass and plastic containers, so a closure with a fixed plug seal will adequately seal the container.

However, for a metallic bottle 40, if an inner plug seal 45 is fixed relative to the closure 43 (which means the inner plug seal 45 will be fixed relative to the bottle threads 42), and the closure threads 82 (shown in FIG. 6) of the closure 43 and the inner surface 61 of the curl 50 are not concentric (as is typical), the closure 43 position relative to the bottle thread datum and the curl inner diameter datum of the metallic bottle 40 will be in conflict. In this scenario, the inner plug seal 45 cannot adjust because it is fixed (or immovable) relative to the closure 43, and the plug seal 45 will be tight on one side of the curl 50 and will have a gap on the other side of the curl 50. This may cause a failure of the seal resulting in spoilage and waste. Specifically, if the floating liner 51 were attached to the closure 43 (as in the prior art), then the inner plug seal 45 will move off center or one side will be sealed tightly and the other side will vent—due to concentricity issues and misalignment between the metallic bottle 40 and closure 43—and the container may vent when it leaves the capping apparatus 22.

In contrast, as shown in FIGS. 8A, 8B, when the closure shell 43 with the floating liner 51 having an inner plug seal 45 is placed on the metallic bottle 40 in the capping apparatus 22, because the floating liner 51 is not attached to the lower surface 70 of the closure 43, the floating liner 51 can move laterally (perpendicular relative to the longitudinal axis 21) as indicated by arrow 48 in FIG. 8B. The lateral movement of the floating liner 51 permits the inner plug seal 45 to align with the inner diameter surface 61 of the bottle curl 50 and at the same time is able to freely misalign with the closure shell 43 and bottle threads 42 as needed. When the closed and sealed metallic bottle 40 is released from the capping apparatus 22, the closure 43 will align itself with the bottle threads 42 since the bottle threads are robust metal (e.g., aluminum) structures compared to the relatively weaker and/or more flexible plastic, polymer, HDPE, LDPE, or other material of the floating liner 51 and its inner plug seal 45.

FIGS. 8A and 8B show the concept of having the concentricity of the inner surface 61 (which defines the bore of the metallic bottle 40) and the closure 43 misaligned. FIG. 8A shows the curl 50 concentrically aligned with the closure 43, as would happen in a perfect world but rarely happens in practice. See the data in Table 1 and the concentricity drawing in FIG. 11.

FIG. 8B shows both the outer diameter 60 of the bottle threads 42 and the metallic closure 43 in the same position as in FIG. 8A. However, the bottle curl 50A in FIG. 8B is not perfectly concentric and its inner diameter surface 61B is positioned to the right (radially outward) a distance 59 on the right side of the metallic bottle 40 shown, i.e., in this cross-sectional view, compared to the properly positioned inner diameter surface 61 of the bottle curl 50 of FIG. 8A. Typically, this would mean that the left side of the curl 50A in the same cross-sectional view (not shown in FIG. 8B) would also be shifted the same distance 59 to the right. The floating liner 51 can slide a distance 59 laterally to the right (in this cross-sectional view) to compensate for the improperly positioned curl 50A. Thus, the floating liner 51 and its inner plug seal 45 remain correctly positioned about the curl 50A. The arrow 48 on the floating liner 51 in FIG. 8B shows the direction that the floating liner 51 will slide due to the non-concentric curl 50A. Since the left side of the curl 50A in the same cross-sectional view (not shown) would also be shifted the distance 59 to the right, the floating liner 51 and specifically the inner plug seal 45 remains correctly positioned on the opposite side (left in this view) curl 50.

The floating aspect of the floating liner 51 and its inner plug seal 45 is critical to allow the inner plug seal 45 to align with the bore (i.e., the inner diameter surface 61 of the bottle curl 50), while allowing the metallic closure 43 to freely align to the bottle threads 42 without creating stress on the inner plug seal 45. This is a major improvement over the prior art liners 14 and seals secured to the metallic closure shell 10.

One prior art system described in U.S. Pat. No. 9,821,931, is a metallic can with a recloseable metallic cap with a liner adhered to the cap. In this prior art system, topload is used with torque to finish off the closing process such that the system self-tightens. Specifically, this patent discloses pre-torquing the cap and can during the closing process because torque gives the system extra compression. However, ROPP closures cannot use torque without a special custom capper that could reform the seal, form the threads and pilfer, and then have an additional machine element to allow applying torque to the bottle. Accordingly, applying the torque may require two separate capping turrets where the first turret performs a typical ROPP application and the second capper turret performs a typical torque application. This would mean twice the number of cappers and double the equipment cost, plus it would increase the time required to close/cap the container. Moreover, a ROPP capper must tightly form the tamper band to the metallic bottle. If the tamper band is formed loosely, not all of the tamper band bridges will be broken when the closure is completely unthreaded. By first forming the pilfer band tightly in a ROPP application and then torquing the closure on in a closing direction, the pilfer band will move downward from the bottle mating surface and will become loose.

Figure 9:
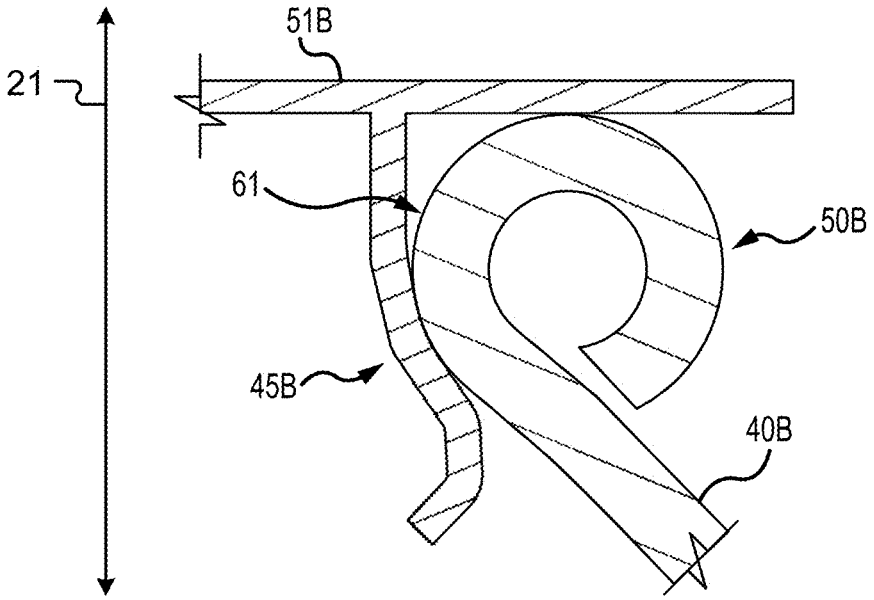
FIG. 9 shows an alternative embodiment of the bottle curl having a generally circular cross-sectional shape and a floating liner with an inner plug seal according to embodiments of the disclosure.

FIG. 9 shows an alternative embodiment where the bottle curl 50B has a circular shape instead of a flat/straight inner diameter surface and a flat/straight outer diameter surface of the curls 50 of other embodiments such as shown in FIG. 5C. The floating liner 51B according to embodiments illustrated in FIG. 9 includes an inner plug seal 45B formed to have an interference fit and adapted to expand into the space under the bottle curl 50B. This configuration would also allow for some vertical movement of the inner plug seal 45B without causing a failure of the seal (allowing the container to vent) if the metallic bottle 40 is pressurized and the closure 43 domes upwardly as shown in FIG. 7B.

Figure 10:
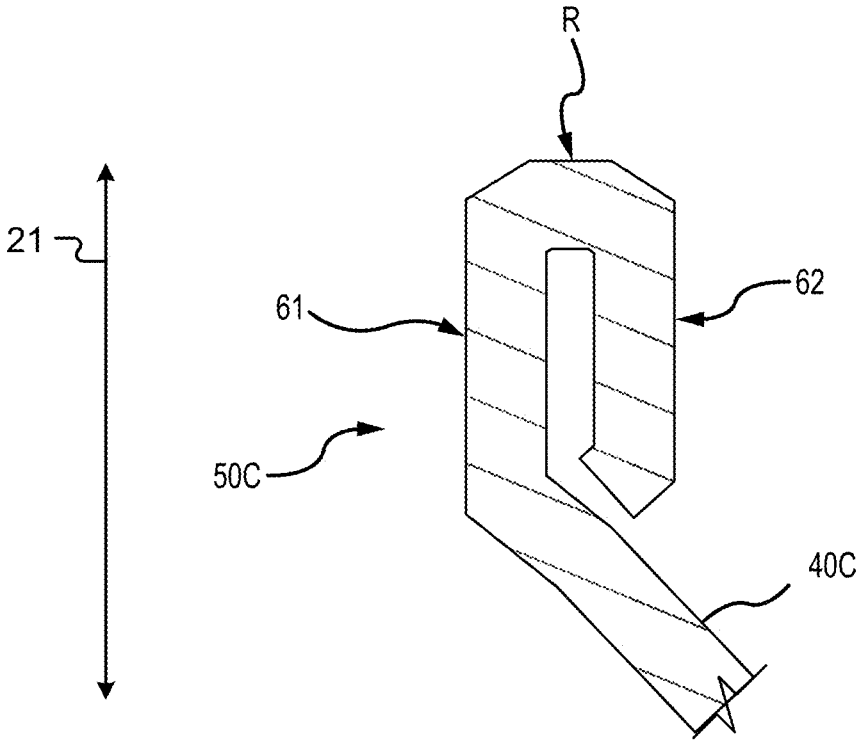
FIG. 10 shows an alternative embodiment of a bottle curl with an alternative cross-sectional shape for the bottle curl.

In some embodiments, the bottle curl 50B may have a round outer curl geometry (as shown in FIG. 9) and a flat inner diameter surface (as shown in FIG. 10) similar to a reflection of the prior art curl 6 shown in FIG. 4. In some embodiments, a distal end of the plug seal 45B bends inwardly toward the longitudinal axis 21 of the metallic bottle 40B. Alternatively, in other embodiments, the distal end of the plug seal 45B may not curve away from the inner wall of bottle curl 50B, but may instead run parallel therewith. Alternatively, the distal end of the plug seal 45B may end in a widening (such as a bulbous portion) thereby barring the occurrence of venting.

FIG. 10 shows an alternate embodiment for the shape of the bottle curl 50C. As discussed above with FIGS. 5 and 7, the bottle curl 50 can have an elongated inner diameter surface 61 (also called the straight portion of the inner diameter surface 61 of the curl 50C because in some embodiments it is straight or flat when viewed in cross-section) and an elongated curl outer diameter surface 62 (also called the straight portion of the outer diameter surface 62 of the curl 50C because it is straight or flat when viewed in cross-section). The two straight portions 61, 62 of the curl 50C convert a typically round/circular curl into a vertically elongated tangent oval. The width of the curl 50C oval is about two times the curl top radius of curvature R. Alternatively, the curl inner diameter surface 61 can be moved outward (away from the longitudinal axis 21 and toward the right in FIG. 10) such that the top of the straight portion of the inner diameter surface 61 is no longer tangent with the radius of curvature R of the curl top.

There are some benefits of the configuration of the curl 50C of FIG. 10 over the curl 50B of FIG. 9. First, the vertical extent of the inner surface 61 of the curl 50C is larger than the vertical extent of the inner surface 61 of the bottle curl 50B in FIG. 9, which provides more surface for engagement by the inner plug seals of the floating liners 51 of the current disclosure.

In addition, the inner surface 61 of curl 50C is further from the longitudinal axis 21 than for the inner surface 61 of curl 50B (where the longitudinal axes 21 are positioned concentrically with the metallic bottles 40B, 40C). As described herein in conjunctions with FIGS. 7A, 7B, moving the inner surface 61 of curl 50B away from the longitudinal axis 21 reduces the magnitude of vertical movement of the inner plug seal 45 upwardly after a container is pressurized.

Another benefit of the curl 40C is that the because the inner surface 61 is generally linear, the vertical distance between the top of the curl 50C and the top of the straight portion of the inner surface 61 is shortened. Therefore, the mating geometry of the inner plug seal 45 can be shorter, which means less material is used and there is a shorter cantilevered stable sealing feature. Finally, the length of the straight portion of the inner surface 61 of curl 50C is obtained with less metal than would be required to obtain a straight portion of an inner diameter surface of curl 50B that has the same length.

In the curl 50C shown in FIG. 10, the outer diameter surface 62 of the curl 50C is straight or flat. This helps to minimize the radial distance between the constraining thread root diameter 53 (shown in FIG. 5A) and the outer surface 62 of the curl, which helps to reduce the vertical movement 58 of the plug seal 45, as described above in connection with FIG. 7B since the plug seal 45 may be formed closer to the outer diameter of the closure 43. Moreover, having a straight/flat outer diameter surface 62 of the bottle curl 50C minimizes the width of the bottle curl 50C, which minimizes the material used in the bottle curl 50C structure. Reducing the amount of material used reduces the cost and increases sustainability. However, the container (metallic bottle 40 and closure 43 with a floating liner 51 and plug seal 45) would function adequately and similar to the embodiment shown in FIG. 10 if the outer surface 62 of curl 50C was not flattened and instead was round like the outer diameter surface of curl 50B in FIG. 9.

Table 1 includes the data from measuring three metallic bottles to collect data for concentricity of the curl diameter versus the thread diameter. The average non-concentricity was 0.007 inch. Some plastic bottles and their associated plastic closures have a diameter interference of 0.010 inch (e.g., the plug diameter is 1.205 inch and the container bore is 1.195 inch). In some current aluminum bottles, non-concentricity combined with a rigidly attached plug seal liner concentricity would exceed the 0.010 inch interference, and, therefore, would force the closure plug seal to one side of the bottle curl, which would allow for venting on the uncompressed side of the plug seal.

Figure 11:
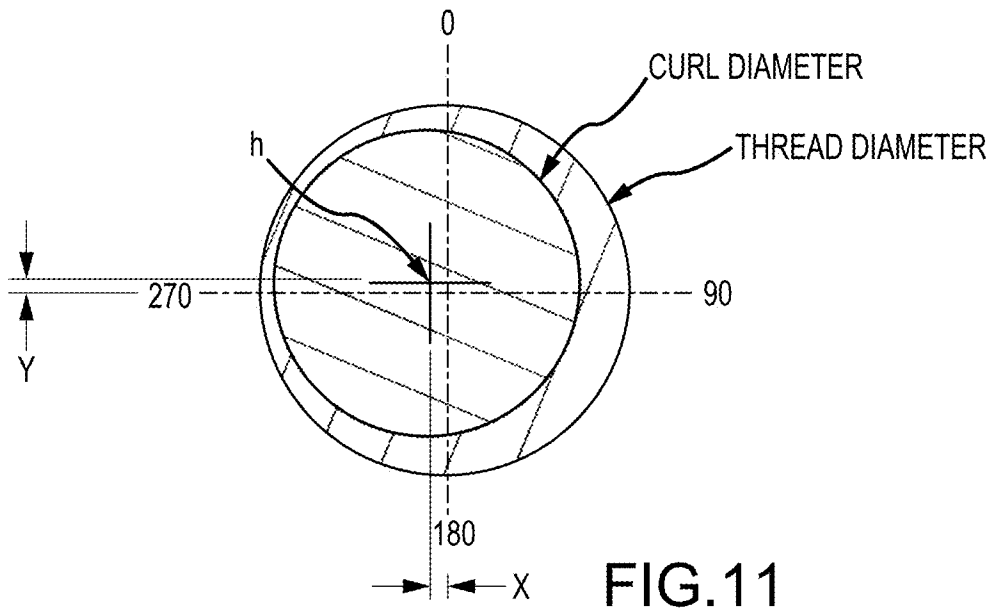
FIG. 11 is a schematic top plan view illustrating the data of Table 1 from metallic bottles with curls that are non-centrically formed with bottle threads, and showing the curl diameter non-concentricity compared to the thread diameter.

FIG. 11 shows the non-concentricity data from the three measured metallic bottles in an image with the curl diameter non-concentricity compared to the thread diameter. The non-concentricity is labeled as "h" in FIG. 11.

Any of the embodiments described herein can include a metallic closure 43 made of any metal, but preferably an aluminum alloy. For example, AA3105, AA5017, and AA5050 aluminum alloys may be used or other aluminum alloys can be used, such as the aluminum alloys described in U.S. Patent Application Publication 2014/0298641 which is incorporated herein by reference in its entirety.

Any of the embodiments described herein can include a floating liner 51 that is polymer or plastic. For example, the floating liner 51 could be HDPE, LDPE, or another plastic or polymer. Polymer liners having an engagement element such as an inner plug seal 45 may need a method of reducing oxygen ingress or CO2 loss, for example via an oxygen barrier. The oxygen barrier may be one or more of a separate co-injected layer within the closure 43, blended into the material of the floating liner 51, and/or as a layer or coating of the inner plug seal 45.

Additionally, or alternatively, the floating liner 51 and/or the closure 43 may comprise oxygen scavenger materials. For example, oxygen scavenger materials may be a layer in the floating liner or mixed in the resin of the floating liner. Alternatively, the oxygen scavenger materials may comprise an external coating of portions of the closure 43 and/or the floating liner 51. The oxygen scavenger materials may be a silicon dioxide or other coating. The oxygen scavengers may be positioned on or in the floating liner 51 and/or the closure 43 to capture oxygen as it transmits into the package (the metallic bottle 40 sealed by the closure 43). Any of the above-mentioned oxygen scavengers or other methods of reducing oxygen ingress can be used with any of the embodiments of the present disclosure.

In some of the embodiments described herein, the floating liner 51 may comprise an aluminum the same as (or similar to) the closure shell 43. In these embodiments, the floating liner 51 may have a coating, e.g., a rubberized coating on the inner plug seal 45 or an O-ring type element at the inner plug seal 45. One advantage of the metallic (e.g., aluminum or alloy thereof) floating liner 51 with the inner plug seal 45 is that it would have zero oxygen ingress through the metal, or alloy thereof, but some small amount may ingress through the polymer material.

In some embodiments, the floating liner 51 is formed of only one material. The material of the floating liner may be an elastic material such as a polymer or a hard, low-friction material, for example HDPE, LDPE, aluminum, or other material. With the floating liner 51 formed of a hard, low-friction material, the torque required by the user to open the container (e.g., twisting off the closure 43) would be lower than closures with elastic/rubbery seals and/or liners.

In other embodiments, the floating liner 51 comprises more than one material. For example, a first portion of the floating liner 51 may comprise a first material and a second portion of the floating liner may comprise a second material. In at least one embodiment, the first and second materials may have different coefficients of friction and/or hardness to increase the seal strength and not require too much force from the user to open the container.

In at least one embodiment, the floating liner 51 comprises a first material with a first durometer, and a second material with a second durometer that is less than the first durometer.

In one or more embodiments, the floating liner 51 comprises an inner plug seal 45 that comprises the second material.

In some embodiments, the inner plug seal 45 is formed of the first material and the second material coats or covers at least an outer surface of the inner plug seal 45, the outer surface configured to contact an inner surface 61 of a curl 50 of a metallic bottle 40.

In other embodiments, the inner plug seal 45 consists of the second material.

The concepts illustratively disclosed herein suitably may be practiced in the absence of any element which is not specifically disclosed herein. It is apparent to those skilled in the art, however, that many changes, variations, modifications, other uses, and applications of the disclosure are possible, and changes, variations, modifications, other uses, and applications that do not depart from the spirit and scope of the disclosure are deemed to be covered by the disclosure.

The foregoing discussion has been presented for purposes of illustration and description. The foregoing is not intended to limit the disclosure to the form or forms disclosed herein. In the foregoing Detailed Description, for example, various features are grouped together in one or more embodiments for the purpose of streamlining the disclosure. The features of the embodiments may be combined in alternate embodiments other than those discussed above. This method of disclosure is not to be interpreted as reflecting an intention that the claims require more features than are expressly recited in each claim. Rather, as the following claims reflect, inventive aspects lie in less than all features of a single foregoing disclosed embodiment. Thus, the following claims are hereby incorporated into this Detailed Description, with each claim standing on its own as a separate embodiment.

Moreover, though the present disclosure has included description of one or more embodiments and certain variations and modifications, other variations, combinations, and modifications are within the scope of the disclosure, e.g., as may be within the skill and knowledge of those in the art, after understanding the present disclosure. It is intended to obtain rights that include alternative embodiments to the extent permitted, including alternate, interchangeable, and/or equivalent structures, functions, ranges, or steps to those claimed, regardless of whether such alternate, interchangeable, and/or equivalent structures, functions, ranges, or steps are disclosed herein, and without intending to publicly dedicate any patentable subject matter.

The present disclosure, in various aspects, embodiments, and/or configurations, includes components, methods, processes, systems and/or apparatus substantially as depicted and described herein, including various aspects, embodiments, configurations embodiments, subcombinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

It is to be appreciated that any feature described herein can be claimed in combination with any other feature(s) as described herein, regardless of whether the features come from the same described embodiment.

What is claimed is:

1. A closure for sealing a metallic bottle, comprising:

a closure shell, comprising:

a top portion with an upper surface that is generally circular and a lower surface opposite the upper surface;

a closure body extending from the top portion; and a plurality of retaining elements formed around a circumference of the closure body, each retaining element projecting inwardly toward a longitudinal axis extending through a center of the top portion; and a floating liner positioned within the closure body proximate to the lower surface, the floating liner comprising:

a top surface that is generally circular, the top surface positioned proximate to the lower surface of the closure shell; and an inner plug seal extending away from the top surface, wherein the top surface is movable relative to the lower surface such that the inner plug seal can move laterally relative to the longitudinal axis, and wherein the plurality of retaining elements retain the floating liner within the closure body.

2. The closure of claim 1, wherein the floating liner comprises a polymer material.

3. The closure of claim 1, wherein the floating liner is formed of a first material and a second material coats at least a portion of the inner plug seal.

4. The closure of claim 3, wherein the second material is a polymer material or an elastomeric material that is different from the first material.

5. The closure of claim 3, wherein the first material has a first hardness of a first durometer and the second material has a second hardness of a second durometer that is less than the first durometer.

6. The closure of claim 1, wherein the closure shell is unthreaded and at least a portion of the closure body is configured to be threaded when the closure is used to seal the metallic bottle.

7. The closure of claim 1, wherein the closure shell comprises closure threads formed before the closure is used to seal the metallic bottle.

8. The closure of claim 1, wherein the closure shell comprises a plurality of lugs configured to retain the closure on the metallic bottle when the closure is used to seal the metallic bottle.

9. The closure of claim 1, wherein the top surface of the floating liner is not attached or affixed to the lower surface of the closure shell.

10. The closure of claim 1, wherein the floating liner further comprises an outer alignment support extending away from the top surface, wherein the outer alignment support is positioned outward of the inner plug seal such that a curl of the metallic bottle is positioned between the inner plug seal and the outer alignment support when the closure is used to seal the metallic bottle.

11. The closure of claim 10, further comprising an upper bumper positioned between the inner plug seal and the outer alignment support.

12. The closure of claim 1, wherein the closure shell is formed of a metallic material.

13. The closure of claim 1, wherein a maximum outer diameter of the floating liner is greater than a minimum interior diameter of the closure body defined by the plurality of retaining elements.

14. A metallic bottle with a closure that is selectively removable, comprising:

the closure, comprising:

a top portion with an upper surface and a lower surface opposite the upper surface;

a closure body extending from the top portion;

a plurality of retaining elements formed around a circumference of the closure body, each retaining element projecting inwardly toward a longitudinal axis extending through a center of the top portion; and a floating liner positioned within the closure body proximate to the lower surface, the floating liner comprising:

a top surface that is generally circular, the top surface facing the lower surface of the closure, wherein the top surface of the floating liner is not attached to the lower surface to permit movement of the floating liner relative to the lower surface; and an inner plug seal extending away from the top surface, wherein the inner plug seal can move laterally relative to the longitudinal axis, and wherein the plurality of retaining elements retain the floating liner within the closure body; and the metallic bottle, comprising:

a body portion having a sidewall extending upwardly from a closed bottom;

a neck portion extending upwardly from the sidewall;

container threads formed on at least a portion of the neck portion; and a curl at an uppermost portion of the neck portion, the curl defining an open end opposite the closed bottom, wherein the inner plug seal of the floating liner contacts an inner surface of the curl to seal the metallic bottle.

15. The metallic bottle of claim 14, wherein the inner surface of the curl is substantially linear when viewed in cross-section, and wherein the inner surface is substantially parallel to the longitudinal axis extending through the center of the top portion of the closure.

16. The metallic bottle of claim 15, wherein the curl has an outer surface that is substantially linear when viewed in cross-section.

17. The metallic bottle of claim 14, wherein the floating liner further comprises an outer alignment support extending away from the top surface, wherein the outer alignment support is positioned outward of the inner plug seal such that the curl is positioned between the inner plug seal and the outer alignment support.

18. The metallic bottle of claim 14, wherein the container threads have a thread root diameter, wherein the curl has an outer surface with a maximum outer curl diameter, and wherein the maximum outer curl diameter is at least about 95% of the thread root diameter.

19. A method of applying a metallic closure to a metallic bottle, comprising:

providing the metallic bottle, comprising:

a body portion having a sidewall extending upwardly from a closed bottom;

a neck portion extending upwardly from the sidewall;

container threads formed on at least a portion of the neck portion; and a curl at an uppermost portion of the neck portion, the curl defining an open end opposite the closed bottom;

providing the metallic closure, comprising:

a top portion with an upper surface and a lower surface opposite the upper surface;

a closure body extending from the top portion;

a plurality of retaining elements formed around a circumference of the closure body, each retaining element projecting inwardly; and a floating liner positioned within the closure body proximate to the lower surface, the floating liner comprising:

a top surface that is generally circular, the top surface facing the lower surface of the metallic closure, wherein the top surface of the floating liner is movable relative to the lower surface; and an inner plug seal extending away from the top surface, and wherein the plurality of retaining elements retain the floating liner within the closure body;

positioning the metallic closure on the metallic bottle such that the inner plug seal of the floating liner is positioned adjacent to and touching an inner surface of the curl, wherein the floating liner slides within the closure body to align concentrically with the curl of the metallic bottle; and applying a topload to the upper surface of the metallic closure, wherein the topload is less than 100 lbs.

20. The method of claim 19, wherein the topload is less than 25 lbs.

* * * * *